US012352009B2

(12) United States Patent
Hama et al.

(10) Patent No.: US 12,352,009 B2
(45) Date of Patent: Jul. 8, 2025

(54) REMOTE OPERATION ASSISTANCE DEVICE AND REMOTE OPERATION ASSISTANCE METHOD

(71) Applicant: KOBELCO CONSTRUCTION MACHINERY CO., LTD., Hiroshima (JP)

(72) Inventors: Ryota Hama, Hiroshima (JP); Masaki Otani, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 321 days.

(21) Appl. No.: 18/007,810

(22) PCT Filed: Apr. 28, 2021

(86) PCT No.: PCT/JP2021/017099
§ 371 (c)(1),
(2) Date: Dec. 2, 2022

(87) PCT Pub. No.: WO2021/256104
PCT Pub. Date: Dec. 23, 2021

(65) Prior Publication Data

US 2023/0272596 A1 Aug. 31, 2023

(30) Foreign Application Priority Data

Jun. 18, 2020 (JP) ..... 2020-105538

(51) Int. Cl.
*E02F 9/20* (2006.01)
*E02F 9/26* (2006.01)

(52) U.S. Cl.
CPC ..... *E02F 9/205* (2013.01); *E02F 9/2054* (2013.01); *E02F 9/261* (2013.01)

(58) Field of Classification Search
CPC ..... E02F 9/205; E02F 9/2054; E02F 9/261; E02F 9/262; E02F 3/435; G08C 17/00
See application file for complete search history.

(56) References Cited

U.S. PATENT DOCUMENTS 7,657,841 B2 2/2010 Shibamori et al.
2016/0075293 A1 3/2016 Chun
(Continued)

FOREIGN PATENT DOCUMENTS

JP 2005-307483 A 11/2005
JP 2015-192163 A 11/2015
JP 2018-135679 A 8/2018

OTHER PUBLICATIONS

The extended European Search Report dated Sep. 6, 2023 issued in the corresponding EP 21825744.2.

*Primary Examiner* — Rodney A Butler
(74) *Attorney, Agent, or Firm* — Carrier, Shende & Associates P.C.; Joseph P. Carrier; Jeffrey T. Gedeon

(57) ABSTRACT

A remote operation assistance device configured such that when an operator performs work through remote operation of a work machine, the remote operation assistance device moves the work machine to the position suitable for the work scheduled to be performed by the work machine in advance or changes the attitude of the work machine in advance so as to be suitable for the work. The present invention comprises a first assistance processing element configured to execute a first assistance process that is a process of acquiring schedule information from a database, determining based on the schedule information whether or not a preparation condition is satisfied, and transmitting, when the determination is affirmative, a preparation signal that is a control signal.

12 Claims, 15 Drawing Sheets

(56) References Cited

U.S. PATENT DOCUMENTS

2019/0338489 A1 11/2019 Yamanaka et al.
2019/0339693 A1* 11/2019 Menon ..... G05D 1/81

* cited by examiner

REMOTE OPERATION ASSISTANCE DEVICE AND REMOTE OPERATION ASSISTANCE METHOD

TECHNICAL FIELD

The present invention relates to a remote operation assistance device and a remote operation assistance system that assist remote operation that is performed by operating a work machine by an operator operating a remote operation device.

BACKGROUND ART

There has been known a remote operation system for a work machine that is characterized to control the work machine to a standby state when a failure occurs (see, for example, Patent Literature 1).

CITATION LIST

Patent Literature

Patent Literature 1: Japanese Patent Application Laid-Open No. 2015-192163

SUMMARY OF INVENTION

Technical Problem

In Patent Literature 1, when a failure occurs in the remote operation system, the work machine is controlled to the standby state, which makes it possible to avoid the situation where the operator operates the work machine.

The remote operation system for a work machine may perform a first work that is performed with a first work machine as a target of remote operation and a second work that is performed with a second work machine as a target of remote operation by switching the remote operation target from the first work machine to the second work machine. In order to smoothly get to the second work, it is necessary to make a preparation, such as changing the position or the attitude of the second work machine in accordance with the situation immediately before the start of the second work. However, when an operator, who performs the first work by remote operation of the first work machine, attempts to perform a preparation for the second work by the second work machine in addition to and in parallel to the first work, the work efficiency of the first work is deteriorated and the second operation becomes less prepared. When the operator starts to perform the second work without preparation, the work efficiency at the start of the second work is deteriorated.

In view of such background circumstances, an object of the present invention is to provide a remote operation assistance device configured to, when work is performed by selectively switching a target of remote operation to a plurality of work machines, move the work machines to positions suitable for prescribed work or change the attitude of the work machines suitable for the prescribed work in advance.

Solution to Problem

In order to accomplish the above object, the present invention includes a first assistance processing element. The first assistance processing element is configured to execute a first assistance process that is a process of acquiring schedule information that is information including a content of a first work that is the work performed by the first work machine from a database storing the schedule information, determining based on the schedule information whether or not a preparation condition is satisfied, the preparation condition being a condition for causing the first work machine to start preparation for the first work, and transmitting, when the determination is affirmative, a preparation signal that is a control signal for starting preparation for the first work to the first work machine.

(Operational Effects)

According to the present invention, the first assistance processing element determines based on the schedule information whether or not a preparation condition is satisfied, and transmits, when the determination is affirmative, a preparation signal to the work machine, the preparation signal being a control signal for starting preparation for the work scheduled to be performed by the work machine. This starts the control of the work machine that is a target of remote operation such that the work machine moves to a position suitable for the work in advance or to take an attitude suitable for the work in advance. This allows an operator to immediately get to the work as compared with the case of performing the work by operating an unprepared machine, and therefore work efficiency can be enhanced.

DESCRIPTION OF EMBODIMENTS (Configuration of Remote Operation Assistance System)

Figure 1:
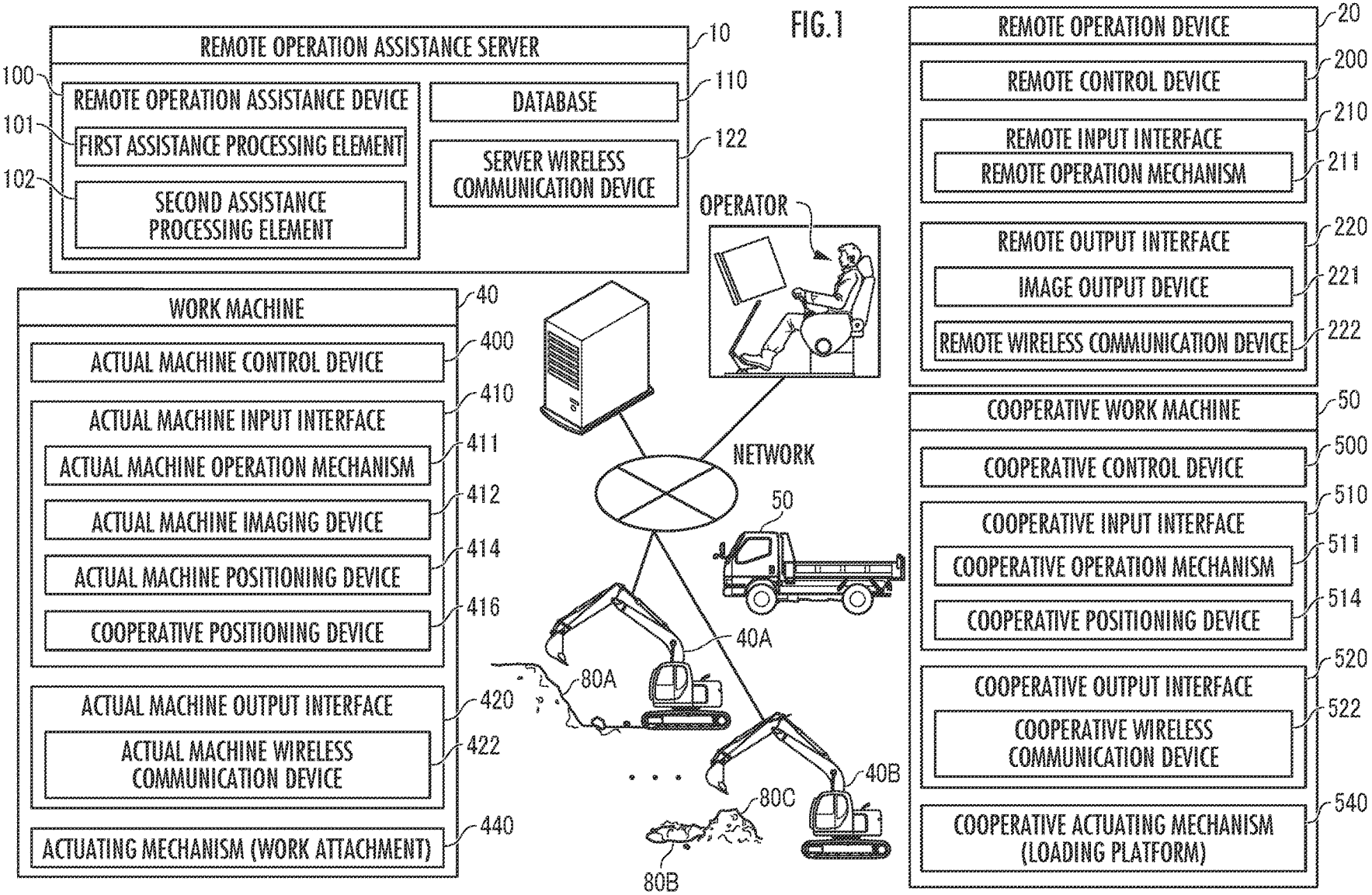
FIG. 1 is an explanatory view about the configuration of a remote operation assistance system as an embodiment of a remote operation assistance device configured according to the present invention.

A remote operation assistance system as an embodiment of a remote operation assistance device 100, configured according to the present invention shown in FIG. 1, includes a remote operation assistance server 10, and a remote operation device 20 for remote operation of a work machine 40. The remote operation assistance server 10, the remote operation device 20, and the work machine 40 are configured to allow network communication with each other. An intercommunication network between the remote operation assistance server 10 and the remote operation device 20 may be identical to or different from an intercommunication network between the remote operation assistance server 10 and the work machine 40.

The number of the work machines 40 may be one or more. When there are more than one work machine 40, a first work machine 40A and a second work machine 40B may be present. The first work machine 40A is a main target of remote operation by an operator. The second work machine 40B becomes a target of remote operation by the operator interrupting the remote operation of the first work machine 40A and switching the target of remote operation from the first work machine 40A. The first work machine 40A and the second work machine 40B may be present in an identical work site or in different work sites. The types of the work machines 40 may be identical or may be different.

For example, the operator can remotely control the first work machine 40A mainly for a slope formation work. In the case where a cooperative work machine 50, which is a dump truck, sometimes comes to the vicinity of the second work machine 40B, the operator can switch the work machine as a target of remote operation from the first work machine 40A to the second work machine 40B each time the dump truck comes, and can thereby perform a loading work that is a work of loading soil and sand into the dump truck. The first work machine 40A and the second work machine 40B may be present in an identical work site (the first work machine 40A and the second work machine 40B are present in a work site A), or may be present in different work sites (the first work machine 40A is present in the work site A, and the second work machine 40B is present in a work site B different from the work site A).

The "remote operation" is a concept indicating an operator operating the work machine 40 at a position distanced from the work machine 40 without riding on the work machine 40.

The "operator" is a concept indicating a person who operates the work machine 40 by operating the remote operation device 20.

(Configuration of Remote Operation Assistance Server)

The remote operation assistance server 10 includes the remote operation assistance device 100, a database 110, and a server wireless communication device 122. The remote operation assistance device 100 includes a first assistance processing element 101, and a second assistance processing element 102. Each of the assistance processing elements, which is constituted of a computation processing device (a single-core processor, or a multi-core processor or a processor core constituting the multi-core processor), reads necessary data and software from memory or other storage devices, and performs later-described computation processing on the data according to the software.

The database 110 stores and retains an attribute of the work machine 40, an operation schedule of the work machine 40, position information on a work site where the work machine 40 is operated, position information on a work target area 80, which is an area in the work site where there is a work object that is a target of the work performed by the work machine 40, image data obtained by imaging the environment of the work site where the work machine 40 is operated, image data of the cooperative work machine 50, and the like.

The database 110 also stores and retains, as the attribute of the work machine 40, information indicating that the work machine 40 is a hydraulic excavator, information about the name of the manufacturer, information on serial number, and the like.

The database 110 may also store and retain, as the operation schedule of the work machine 40, the content of the work to be performed by the work machine 40, start time of the work to be performed by the work machine 40, end time of the work to be performed by the work machine 40, information about the time when the work machine 40 is not in use, and the like.

The database 110 may also store and retain the attribute of the work machine 40 in association, the operation schedule of the work machine 40, the position information on the work site where the work machine 40 is operated, the image data obtained by imaging the environment of the work site where the work machine 40 is operated, and the like.

When there are more than one work machine 40 (for example, the first work machine 40A and the second work machine 40B), the database 110 stores and retains the attribute of each of the work machines 40, the operation schedule of each of the work machines 40, the position information on the work site where each of the work machines 40 is operated, and the image data obtained by imaging the environment of the work site where each of the work machine 40 is operated, and the like.

Figure 2:
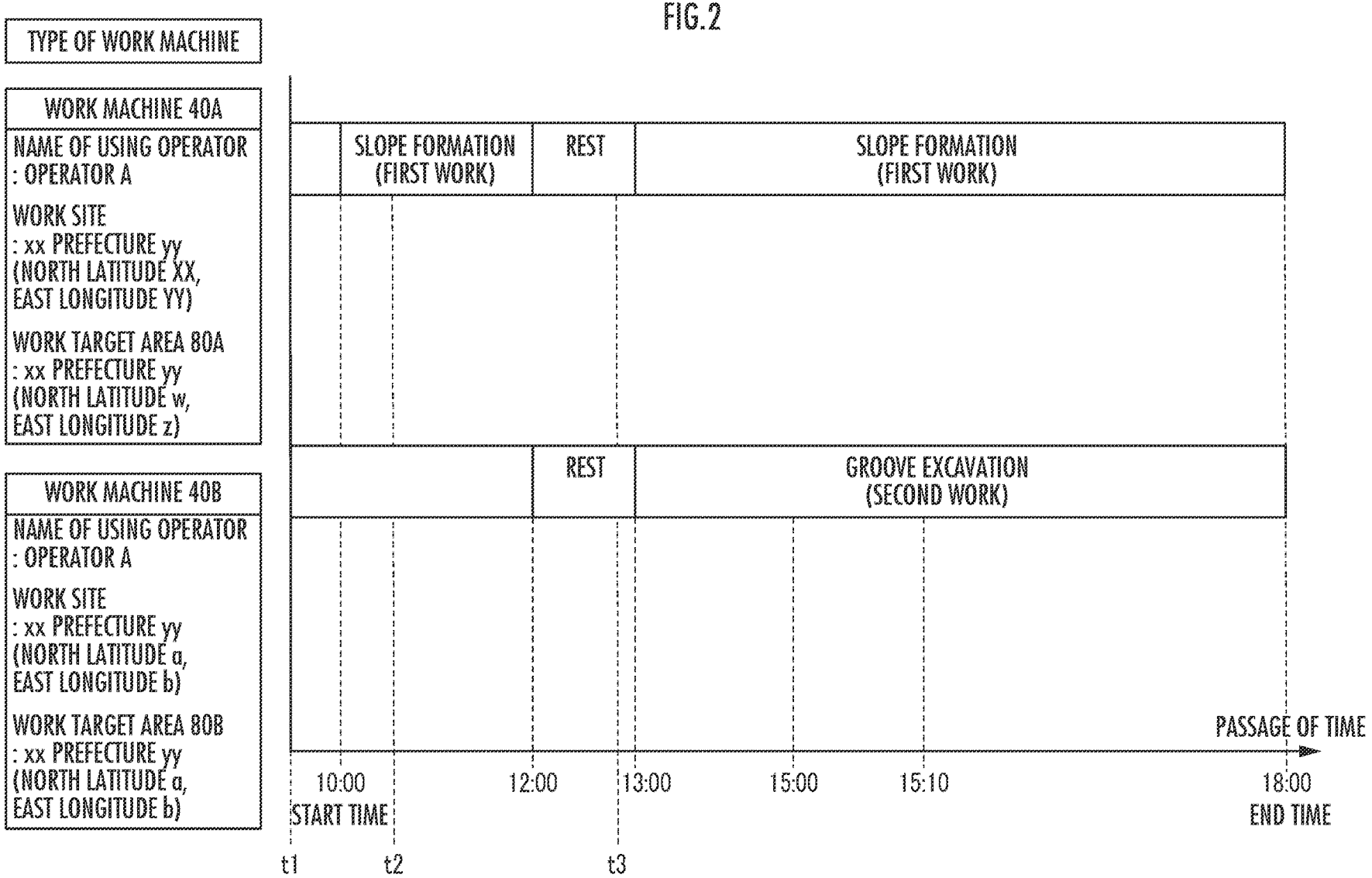
FIG. 2 is an explanatory view about the configuration of a database.

For example, as shown in FIG. 2, the database 110 stores and retains, as information about the first work machine 40A, information about the name of an operator who uses the first work machine 40A, position information on a work site where the first work machine 40A is operated, a work name (slope formation) of the first work performed by the first work machine 40A, start time (10:00, 13:00) of the work name of the first work performed by the first work machine 40A, end time (12:00, 18:00) of the work name of the first work performed by the first work machine 40A, and time (12:00 to 13:00) when the first work machine 40A is not in use in association with each other.

The database 110 also stores and retains, as information about the second work machine 40B, information about the name of an operator who uses the second work machine 40B, position information on a work site where the second work machine 40B is operated, a work name (channel excavation work) of the second work performed by the second work machine 40B, start time (13:00) of the second work performed by the second work machine 40B, end time (18:00) of the work name of the second work performed by the second work machine 40B, and time (10:00 to 13:00) when the second work machine 40B is not in use in association with each other.

Accordingly, since the database 110 stores and retains at least the information about the start time of the first work and the start time of the second work, the first assistance processing element 101 can read the information about the start time of the first work from the database 110 and transmit a command signal to the first work machine 40A so as to move the first work machine 40A to the position suitable for the first work or changes the attitude of the first work machine 40A so as to be suitable for the first work by the start time of the first work.

Similarly, the first assistance processing element 101 can read the information about the start time of the second work from the database 110 and transmit a command signal to the second work machine 40B so as to move the second work machine 40B to the position suitable for the second work or change the attitude of the second work machine 40B so as to be suitable for the second work by the start time of the second work.

(Configuration of Remote Operation Device)

The remote operation device 20 includes a remote control device 200, a remote input interface 210, and a remote output interface 220. The remote control device 200, which is constituted of a computation processing device (a single-core processor, or a multi-core processor or a processor core constituting the multi-core processor), reads necessary data and software from memory or other storage devices, and performs later-described computation processing on the data according to the software. The remote input interface 210 includes a remote operation mechanism 211. The remote output interface 220 includes an image output device 221 and a remote wireless communication device 222.

The remote operation mechanism 211 includes a travel operation device, a turning operation device, a boom operation device, an arm operation device, and a bucket operation device. Each of the operation devices has an operation lever that receives a rotating operation. The operation lever (travel lever) of the travel operation device is operated to move a lower traveling body 450. The travel lever may also function as a travel pedal. For example, the travel pedal may be provided so as to be fixed to a base part or a lower end part of the travel lever. The operation lever (turning lever) of the turning operation device is operated to move a hydraulic turning motor, which constitutes a turning mechanism 430. The operation lever (boom lever) of the boom operation device is operated to move a boom cylinder 442 of the work machine 40. The operation lever (arm lever) of the arm operation device is operated to move an arm cylinder 444 of the work machine 40. The operation lever (bucket lever) of the bucket operation device is operated to move a bucket cylinder 446 of the work machine 40.

Figure 3:
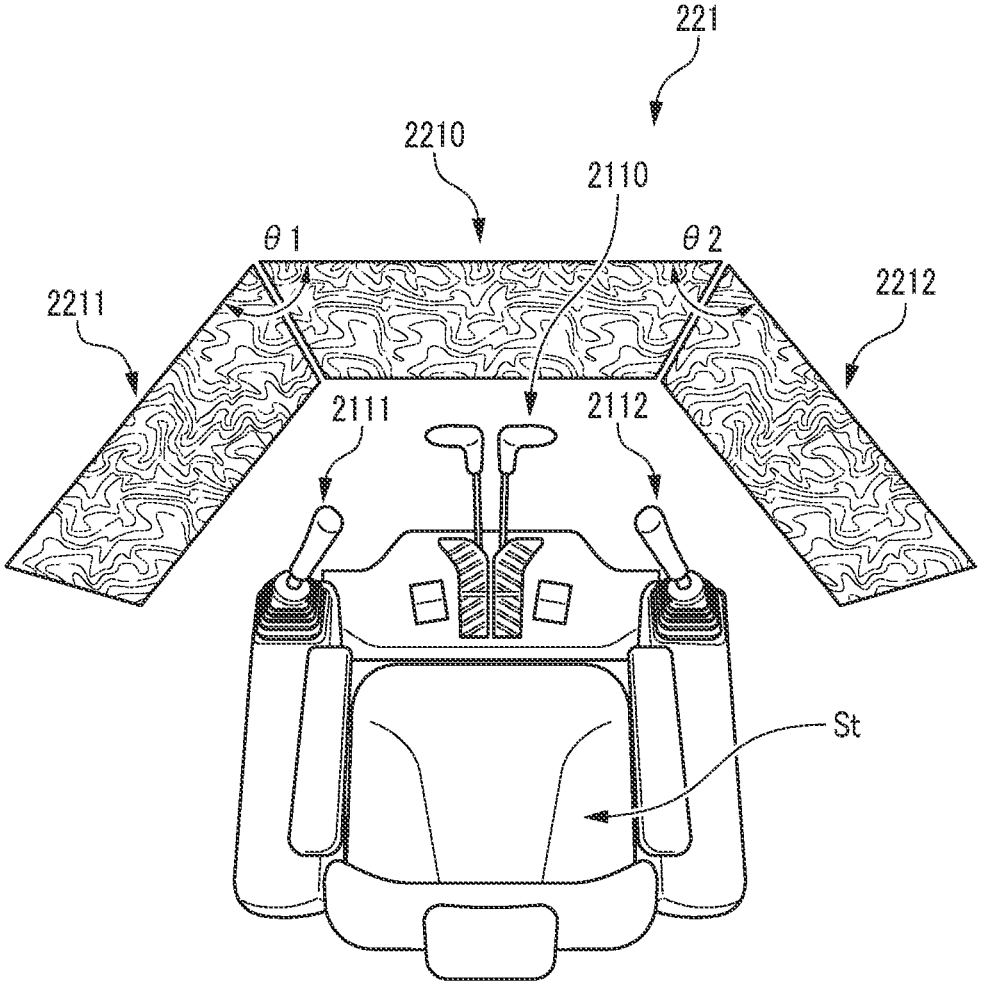
FIG. 3 is an explanatory view about the configuration of a remote operation device.

Each of the operation levers constituting the remote operation mechanism 211 is arranged, for example, around a seat St for the operator to sit on as shown in FIG. 3. Although the seat St has a form of a high-back chair with armrests, the operator can sit on the seat St having a form of low-back chair without a headrest or a form of a chair without a back, etc. The seat St may have a seating part in any form.

In front of the seat St, a pair of right and left travel levers 2110, corresponding to right and left crawlers, are arranged laterally in a row. A single operation lever may function as a plurality of operation levers. For example, a left-side operation lever 2111, provided on the front side of a left-side frame of the seat St shown in FIG. 3, may function as an arm lever when operated in a front-rear direction, and may function as a turning lever when operated in a right-left direction. Similarly, a right-side operation lever 2112, provided on the front side of a right-side frame of the seat St shown in FIG. 3, may function as a boom lever when operated in the front-rear direction, and may function as a bucket lever when operated in the right-left direction. The lever pattern may be optionally changed in response to operation instructions by the operator.

As shown in FIG. 3, the image output device 221 is constituted of, for example, a central image output device 2210 arranged in front of the seat St, a left-side image output device 2211 arranged on a diagonally left front side of the seat St, and a right-side image output device 2212 arranged on a diagonally right front side of the seat St, the image output devices each having a substantially rectangular screen. The screens (image display regions) of the central image output device 2210, the left-side image output device 2211, and the right-side image output device 2212 may be identical in shape and size to each other or may be different in shape and size from each other.

As shown in FIG. 3, a right edge of the left-side image output device 2211 is adjacent to a left edge of the central image output device 2210 such that the screen of the central image output device 2210 and the screen of the left-side image output device 2211 form an inclination angle θ1 (for example, $120° \leq \theta 1 \leq 150°$). As shown in FIG. 3, a left edge of the right-side image output device 2212 is adjacent to a right edge of the central image output device 2210 such that the screen of the central image output device 2210 and the screen of the right-side image output device 2212 form an inclination angle θ2 (for example, $120° \leq \theta 2 \leq 150°$). The inclination angles θ1 and θ2 may be identical or different.

The screens of the central image output device 2210, the left-side image output device 2211 and the right-side image output device 2212 may each be parallel to a perpendicular direction, and may be inclined in the perpendicular direction. At least one image output device, out of the central image output device 2210, the left-side image output device 2211, and the right-side image output device 2212, may be constituted of an image output device divided into a plurality of segments. For example, the central image output device 2210 may be constituted of a pair of image output devices adjacent in an up-down direction, the image output devices each having a substantially rectangular screen. The image output device 221 (the central image output device 2210, the left-side image output device 2211 and the right-side image output device 2212) may each further include a speaker (audio output device).

(Configuration of Work Machine)

The term "work machine 40" refers to a work vehicle operable in work sites. The work machine 40 includes at least one of construction machines capable of pressing or excavating soil and sand. The construction machines are hydraulic excavators with a bucket, and bulldozers with a blade, for example.

Figure 4:
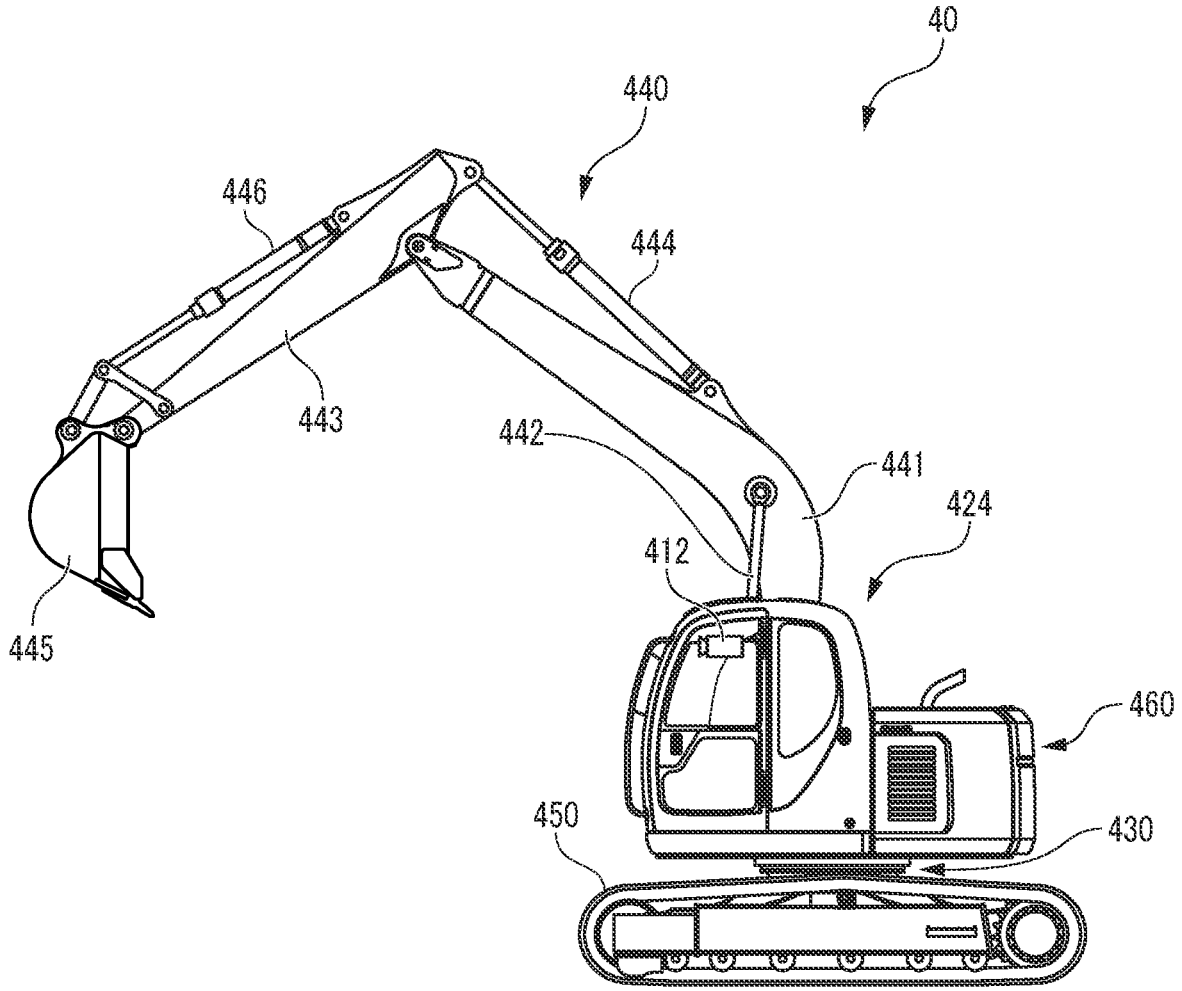
FIG. 4 is an explanatory view about the configuration of a work machine.

The work machine 40 is, for example, a crawler shovel (construction machine) As shown in FIG. 4, the work machine 40 includes a crawler-type lower traveling body 450 and an upper turning body 460 turnably mounted on the lower traveling body 450 through a turning mechanism 430. In a front left-side part of the upper turning body 460, a cab 424 (operator cab) is provided. In a front center part of the upper turning body 460, an actuating mechanism 440 is provided.

An actual machine input interface 410 includes an actual machine operation mechanism 411, an actual machine imaging device 412, an actual machine positioning device 414, and a cooperative positioning device 416. The actual machine operation mechanism 411 includes a plurality of operation levers provided around a seat arranged inside the cab 424 as in the remote operation mechanism 211. The cab 424 is provided with a drive mechanism or a robot which receives signals corresponding to operation modes of remote operation levers and move actual machine operation levers based on the received signals. The actual machine imaging device 412 is installed, for example, inside the cab 424 to image the environment including at least part of the actuating mechanism 440 through a front window and a pair of right and left side windows which are partitioned by a pair of left and right pillars 4240 (with characters "L" and "R" added to distinguish left and right) on the front side of the cab 424. Some or all of the front window and the side windows may be omitted. The actual machine positioning device 414, which is a device that detects the position of the work machine 40, is constituted of a global navigation satellite system (GNSS) receiver, for example.

The cooperative positioning device 416 has a function to identify the position of the cooperative work machine 50 described later. The cooperative positioning device 416 can be constituted of, for example, the actual machine imaging device 412, and a camera and a sensor (a ranging sensor) other than the actual machine imaging device 412, which can obtain information about the working environment. The cooperative positioning device 416 identifies the position of the cooperative work machine 50 relative to the work machine 40 by detecting the shape and size of the cooperative work machine 50 from these camera or sensor.

The actual machine output interface 420 includes an actual machine wireless communication device 422. Information about the position of the work machine 40 detected by the actual machine positioning device 414 is transmitted to the remote operation assistance server 10 through the actual machine wireless communication device 422.

Work attachments as the actuating mechanism 440 include a boom 441 fitted to the upper turning body 460 in a vertically movable manner, an arm 443 rotatably coupled to the tip of the boom 441, and a bucket 445 rotatably coupled to the tip of the arm 443. The actuating mechanism 440 is fitted with a boom cylinder 442, an arm cylinder 444, and a bucket cylinder 446, which are constituted of extendable hydraulic cylinders.

The boom cylinder 442 is interposed between the boom 441 and the upper turning body 460 such that the boom cylinder 442 extends and retracts upon receiving supply of hydraulic oil and thereby rotates the boom 441 in a vertically moving direction. The arm cylinder 444 is interposed between the arm 443 and the boom 441 such that the arm cylinder 444 extends and retracts upon receiving supply of hydraulic oil and thereby rotates the arm 443 around a horizontal axis with respect to the boom 441. The bucket cylinder 446 is interposed between the bucket 445 and the arm 443 such that the bucket cylinder 446 extends and retracts upon receiving supply of hydraulic oil and thereby rotates the bucket 445 around a horizontal axis with respect to the arm 443.

(Configuration of Cooperative Work Machine)

The cooperative work machine 50 is a work machine that cooperates with the work machine 40. For example, the cooperative work machine 50 is a dump truck with a loading platform. The cooperative work machine 50 has a cooperative control device 500, a cooperative input interface 510, a cooperative output interface 520, and a cooperative actuating mechanism 540 (for example, a loading platform).

The cooperative work machine 50 is operated by an operator riding on the cooperative work machine 50, the operator being different from the operator who remotely controls the work machine 40 using the remote operation device 20.

The cooperative work machine 50 includes a loading platform, a vehicle body that supports the loading platform, and a traveling device that performs traveling while supporting the vehicle body.

The loading platform can carry soil and sand. The cooperative work machine 50 is, for example, a rear dump-type truck comprising a gate at a rear part of the loading platform, the gate being configured to open when the front side of the loading platform is raised high while the loading platform is inclined backwards.

The traveling device has wheels, and when the wheels turn, the cooperative work machine 50 can travel.

(Function)

The function of the above-configured remote operation assistance system will be described using flowcharts shown in FIGS. 5 and 6. In the flowchart, blocks prefixed by "C" are used to simplify the description. These blocks signify both or one of data transmission and data reception, and signify condition branches where a process in a branching direction is executed, with both or one of the data transmission and the data reception as a condition.

With the flowchart shown in FIG. 5, the first assistance process in the present embodiment will be described. The first assistance process is a process that is executed to move the work machine 40 to a position suitable for work in advance or to change the attitude of the work machine 40 so as to be suitable for work in advance.

Figure 5:
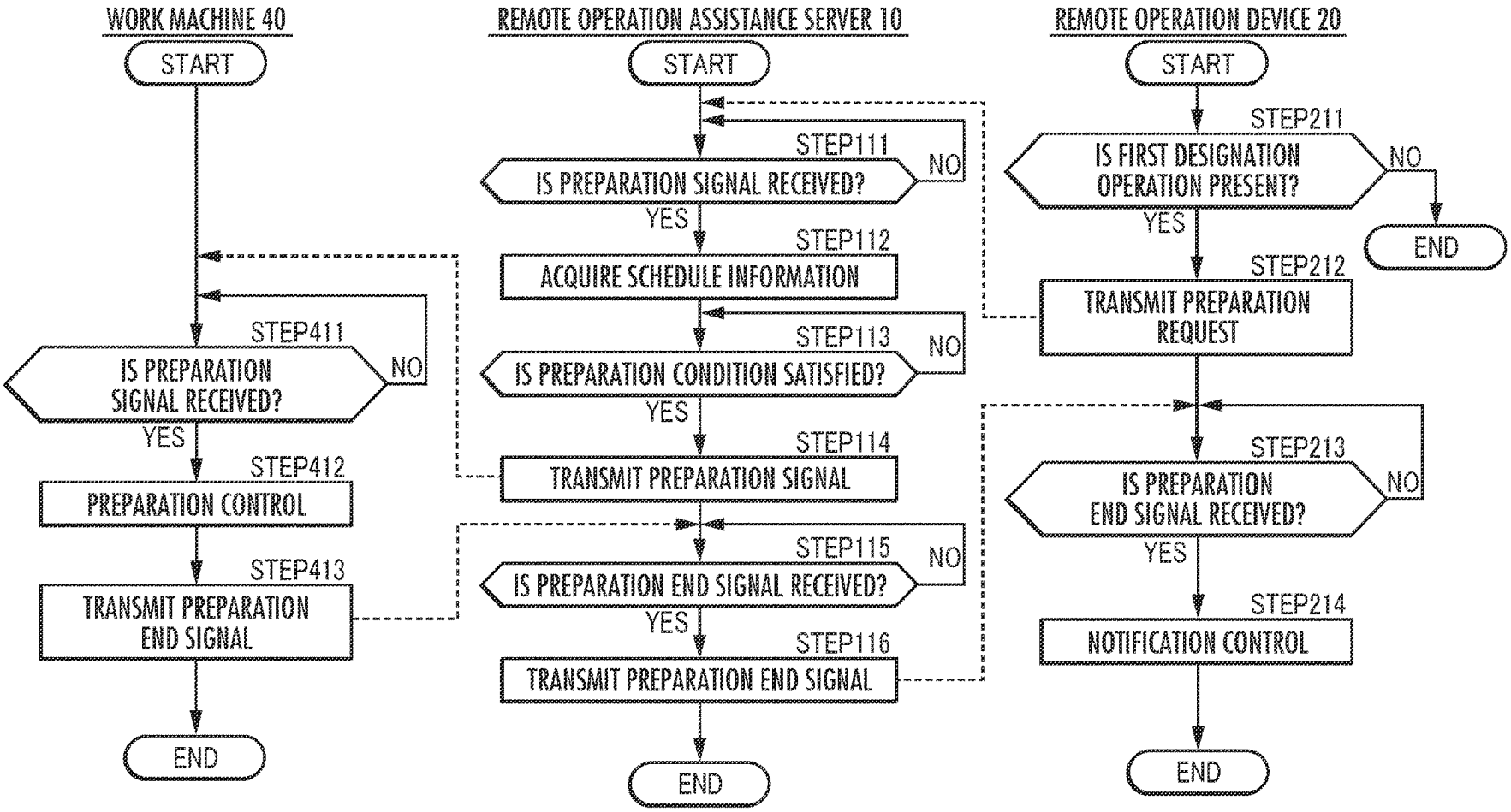
FIG. 5 is an explanatory view about the functions of a first assistance processing element as one embodiment of the remote operation assistance device configured according to the present invention.

The remote operation device 20 determines the presence or absence of first designation operation by the operator through the remote input interface 210 (STEP 211 in FIG. 5). The "first designation operation" is, for example, operation such as the operator tapping, pushing, pinching, and swiping in the remote input interface 210 to designate the work machine 40 as an intended machine for remote operation in the image output device 221.

Another example of the "first designation operation" may be operation such as the operator tapping, pushing, pinching, and swiping in the remote input interface 210 to designate the work as an intended work in the image output device 221. When the determination result is negative (NO in STEP 211 in FIG. 5), the remote operation device 20 ends the process. On the other hand, when the determination result is affirmative (YES in STEP 211 in FIG. 5), the remote operation device 20 transmits a preparation request to the remote operation assistance server 10 through the remote wireless communication device 222 (STEP 212 in FIG. 5).

When the remote operation assistance server 10 receives the preparation request (YES in STEP 111 in FIG. 5), the first assistance processing element 101 reads and acquires the schedule information from the database 110 (STEP 112 in FIG. 5). When the determination result is negative (NO in STEP 111 in FIG. 5), the remote operation assistance server 10 repeats the determination process of STEP 111.

Based on the acquired schedule information, the first assistance processing element 101 determines whether or not a preparation condition is satisfied, the preparation condition being a condition for allowing the work machine 40 to make a preparation for the work scheduled to be performed by the work machine 40 (STEP 113).

In STEP 113, for example, the first assistance processing element 101 acquires information about the current time for the first work machine 40A, and determines whether or not the current time is a time point that is prescribed time (for example, 10 minutes) before the start time of the first work (for example, 10:00).

As shown in FIG. 2, when the current time is time t1 (for example, 9:50) that is prescribed time before the start time (for example, 10:00) of the first work (for example, a slope formation work performed by the first work machine 40A in the morning), the first assistance processing element 101 determines that the preparation condition is satisfied. Meanwhile, when the current time is a time point (for example, 9:40) that is before time t1 that is prescribed time before the start time (for example, 10:00) of the first work (for example, the slope formation work performed in the morning), then the determination result is negative (NO in STEP 113 in FIG. 5), and the first assistance processing element 101 repeats the determination process of STEP 113.

As another example of STEP 113, the first assistance processing element 101 may acquire information about the current time for the second work machine 40B, and determine whether or not the current time is a time point that is prescribed time (for example, 10 minutes) before the start time (for example, 13:00) of the second work. When the current time is time point t3 (for example, 12:50) shown in FIG. 2, and time point t3 is time t3 (for example, 12:50) that is prescribed time (for example, 10 minutes) before the start time (for example, 13:00) of the second work (for example, a loading work sometimes performed by interrupting the first work by the operator), the first assistance processing element 101 determines that the preparation condition is satisfied. On the other hand, when the current time is a time point (for example, 12:40) that is before time t3 that is prescribed time (for example, 10 minutes) before the start time (for example, 13:00) of the second work (for example, a loading work sometimes performed by interrupting the first work by the operator), the determination result is negative (NO in STEP 113 in FIG. 5), and the first assistance processing element 101 repeats the determination process of STEP 113.

When the determination in STEP 113 is affirmative (YES in STEP 113 in FIG. 5), the first assistance processing element 101 transmits a preparation command to the work machine 40 (STEP 114). Meanwhile, when the determination result is negative (NO in STEP 113 in FIG. 5), the first assistance processing element 101 repeats the determination process.

The processes of STEP 112 to STEP 114 described above are the concept of the first assistance process in the present embodiment.

When the work machine 40 receives the preparation signal (YES in STEP 411 in FIG. 5), the work machine 40 performs preparation control that is the control to start preparation for the work scheduled to be performed by the work machine 40 (STEP 412 in FIG. 5). Meanwhile, when the determination result is negative (NO in STEP 411 in FIG. 5), the work machine 40 repeats the determination process of STEP 411.

In STEP 412, the work machine 40 starts to perform control so as to move to the position suitable for the work in advance or to change the attitude suitable for the work in advance. This allows the operator to immediately get to the work as compared with the case of performing the work by operating an unprepared machine, so that work efficiency can be enhanced.

For example, when, in STEP 412, the first work machine 40A waiting in the vicinity of a work target area 80 (for example, a slope 80A) is scheduled to perform the slope formation work in the work target area 80 (for example, the slope 80A), the first work machine 40A starts to travel toward an area in the work site ((north latitude XX, east longitude YY)) where the work target area 80 (for example, the slope 80A) ((north latitude w, east longitude z)) is present.

Although an example in which the first work machine 40A travels toward the work target area 80 (for example, the slope 80A) is shown as an example of the preparation control, examples of the preparation control are not limited to the example described. As another example of the preparation control, the first work machine 40A after moving to the work target area 80 (for example, the slope 80A) may turn the upper turning body 460A so as to direct the actuating mechanism 440A in advance in the direction where the work target area 80 (for example, the slope 80A) is present.

Although an example in which the first work machine 40A performs the preparation control is shown as an example of the preparation control, examples of the preparation control are not limited to the example described. For example, as another example of the preparation control, when, the second work machine 40B waiting in the vicinity of a channel 80B is scheduled to perform an excavation work at the channel 80B, second work machine 40B starts to travel toward the channel 80B ((north latitude a, east longitude b)) where a hole as a target of the excavation work is present, in an area of the work site ((north latitude AA, east longitude BB)).

Although an example in which the second work machine 40B travels toward the channel 80B has been shown as an example of the preparation control, examples of the preparation control are not limited to the example described. As another example of the preparation control, the second work machine 40B may turn the upper turning body 460B with respect to the lower traveling body 450 so as to direct the actuating mechanism 440B in advance in the direction where the channel 80B is present.

Although an example in which the second work machine 40B turns the upper turning body 460B with respect to the lower traveling body 450 so as to direct the actuating mechanism 440B in advance in the direction where the channel 80B is present has been shown as an example of the preparation control, examples of the preparation control are not limited to the example described. As another example of the preparation control, there may be a control example in which the second work machine 40B excavates the channel 80B in the direction where the second work machine 40B is present in order to extend the length of the channel 80B.

Figure 8A:
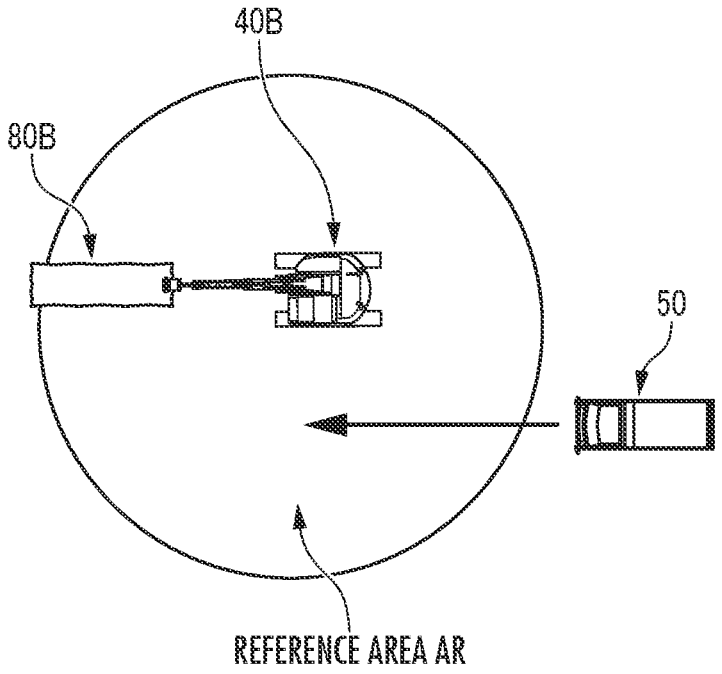
FIG. 8A is an explanatory view of the preparation control as another embodiment of the present invention.

In this example, as shown in FIG. 8A, the channel 80B is already excavated, and in this state, preparation control is performed to operate the lower traveling body 450 of the second work machine 40B so as to move the second work machine 40B to the position in the vicinity of the channel 80B in order to further excavate the channel 80B in the direction where the second work machine 40B is present. This makes it possible to position the actuating mechanism 440B at a proximal-end side of the channel 80B in advance. (Note that one end of the channel 80B closer to the second work machine 40B is referred to as the proximal-end side.)

This allows the operator to excavate at the proximal-end side of the channel 80B using the actuating mechanism 440B (bucket 445B) immediately after the target of remote operation is changed from the first work machine 40A to the second work machine 40B.

In this case, it is also possible to execute the control of turning the upper turning body 460B with respect to the lower traveling body 450B to ensure that the actuating mechanism 440B is surely directed in the direction where the channel 80B is present.

When the preparation for the work is finished, the work machine 40 transmits a preparation end signal, which is a signal including a signal of notifying the operator of the completion of the preparation for the work, to the remote operation assistance server 10 through the actual machine wireless communication device 422 (STEP 413 in FIG. 5).

In the remote operation assistance server 10, when the first assistance processing element 101 receives the preparation end signal (YES in STEP 115 in FIG. 5), the first assistance processing element 101 transmits the preparation end signal to the remote operation device 20 (STEP 116 in FIG. 5). On the other hand, when the determination result is negative (NO in STEP 115 in FIG. 5), the first assistance processing element 101 repeats the determination process of STEP 115.

In the remote operation device 20, when the remote control device 200 receives the preparation end signal (YES in STEP 213 in FIG. 5), the remote control device 200 performs notification control that is control for notifying the operator of the information about the completion of the preparation for the work performed by the work machine 40 (STEP 214 in FIG. 5). For example, the remote control device 200 executes a control process for displaying a text message "Preparation of work machine 40 is finished" on the image output device 221 as the notification control. Of course, the text message displayed on the image output device 221 is not limited to this example.

Although a text message is displayed on the image output device 221 as an example of the notification control, the notification control is not limited to this example. As another example of the notification control, a voice message "Preparation of work machine 40 is finished" may be output from a speaker provided in the image output device 221. Of course, the voice message output from a speaker provided in the image output device 221 is not limited to this example.

On the other hand, when the determination result is negative (NO in STEP 213 in FIG. 5), the remote control device 200 repeats the determination process in STEP 213.

With the flowchart shown in FIG. 6, the second assistance process in the present embodiment will be described. The second assistance process is a process to assist the remote operation of the work machine 40 actually performed by the operator using the remote operation mechanism 211.

Figure 6:
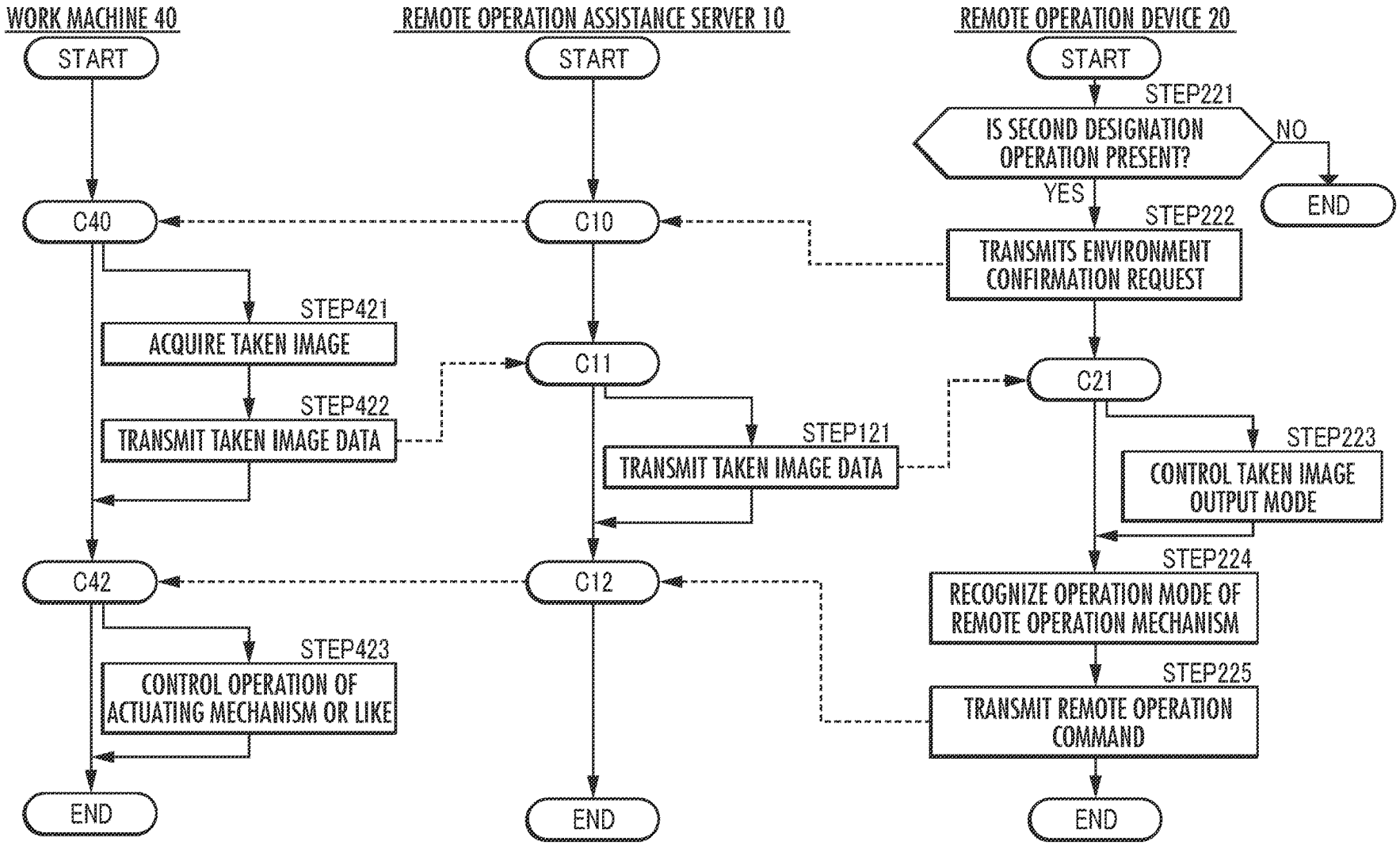
FIG. 6 is an explanatory view about functions of a second assistance processing element as one embodiment of the remote operation assistance device configured according to the present invention.

In the remote operation device 20, the remote control device 200 determines the presence or absence of second designation operation by an operator through the remote input interface 210 (STEP 211 in FIG. 6). The "second designation operation" is, for example, operation, such as the operator tapping, pushing, pinching, and swiping in the remote input interface 210 in the image output device 221 to designate the work machine 40 as an intended machine for remote operation. When the determination result is negative (NO in STEP 221 in FIG. 6), the remote control device 200 repeats the process of determining the presence or absence of the designation operation and onward. On the other hand, when the determination result is affirmative (YES in STEP 221 in FIG. 6), the remote control device 200 transmits an environment confirmation request to the remote operation assistance server 10 through the remote wireless communication device 222 (STEP 222 in FIG. 6).

When the remote operation assistance server 10 receives the environment confirmation request, the second assistance processing element 102 transmits the environment confirmation request to a pertinent work machine 40 (C10 in FIG. 6).

When the work machine 40 receives the environment confirmation request through the actual machine wireless communication device 422 (C40 in FIG. 6), the actual machine control device 400 acquires a taken image through the actual machine imaging device 412 (STEP 421 in FIG. 6). The actual machine control device 400 transmits taken image data representing the taken image to the remote operation assistance server 10 through the actual machine wireless communication device 422 (STEP 422 in FIG. 6).

When the second assistance processing element 102 receives the taken image data in the remote operation assistance server 10 (C11 in FIG. 6), the second assistance processing element 102 transmits the taken image data to the remote operation device 20 (STEP 121 in FIG. 6). The second assistance processing element 102 may transmit, to the remote operation device 20, environment image data representing a simulated environment image generated based on the taken image, in place of the taken image data. In this case, the second assistance processing element 102 may transmit to the remote operation device 20 a command to divide and display the taken image data on the central image output device 2210, the left-side image output device 2211, and the right-side image output device 2212.

In the remote operation device 20, when the remote control device 200 receives the taken image data through the remote wireless communication device 222 (C21 in FIG. 6), the remote control device 200 controls a mode of dividing and displaying a taken image corresponding to the taken image data on the central image output device 2210, the left-side image output device 2211, and the right-side image output device 2212 (STEP 223 in FIG. 6).

In the remote operation device 20, the remote control device 200 recognizes an operation mode of the remote operation mechanism 211 (STEP 224 in FIG. 6), and the remote control device 200 transmits a remote operation command corresponding to the operation mode to the remote operation assistance server 10 through the remote wireless communication device 222 (STEP 225 in FIG. 6).

In the remote operation assistance server 10, when the second assistance processing element 102 receives the remote operation command, the second assistance processing element 102 transmits the remote operation command to the work machine 40 (C12 in FIG. 6).

In the work machine 40, when the actual machine control device 400 receives the operation command through the actual machine wireless communication device 422 (C42 in FIG. 6), the actual machine control device 400 controls operation of the actuating mechanism 440 or the like (STEP 423 in FIG. 6). For example, a work of scooping up the soil in front of the work machine 40 by the bucket 445, turning the upper turning body 460, and then dropping the soil from the bucket 445 is executed.

Other Embodiments of Present Invention

In the above embodiment, an example in which the first assistance processing element 101 transmits a preparation signal to the work machine 40 based on the schedule information (for example, information about the start time of the work) has been described. However, the present invention is not limited to such an example. For example, there may be an example in which the first assistance processing element 101 acquires information about a distance between the second work machine 40B and the cooperative work machine 50, and the first assistance processing element 101 transmits a preparation signal to the second work machine 40B.

Such another embodiment will be described with reference to FIGS. 2 and 7. The processing flow identical to that in the above embodiment is designated by identical STEP numbers to omit description as appropriate.

As shown in FIG. 2, the database 110 stores and retains, as the operation schedule of the work machines 40, the first work (a slope formation work) performed by the first work machine 40A after 13:00 and the second work (for example, a channel excavation work sometimes performed by the operator interrupting the first work) performed by the second work machine 40B.

Figure 7:
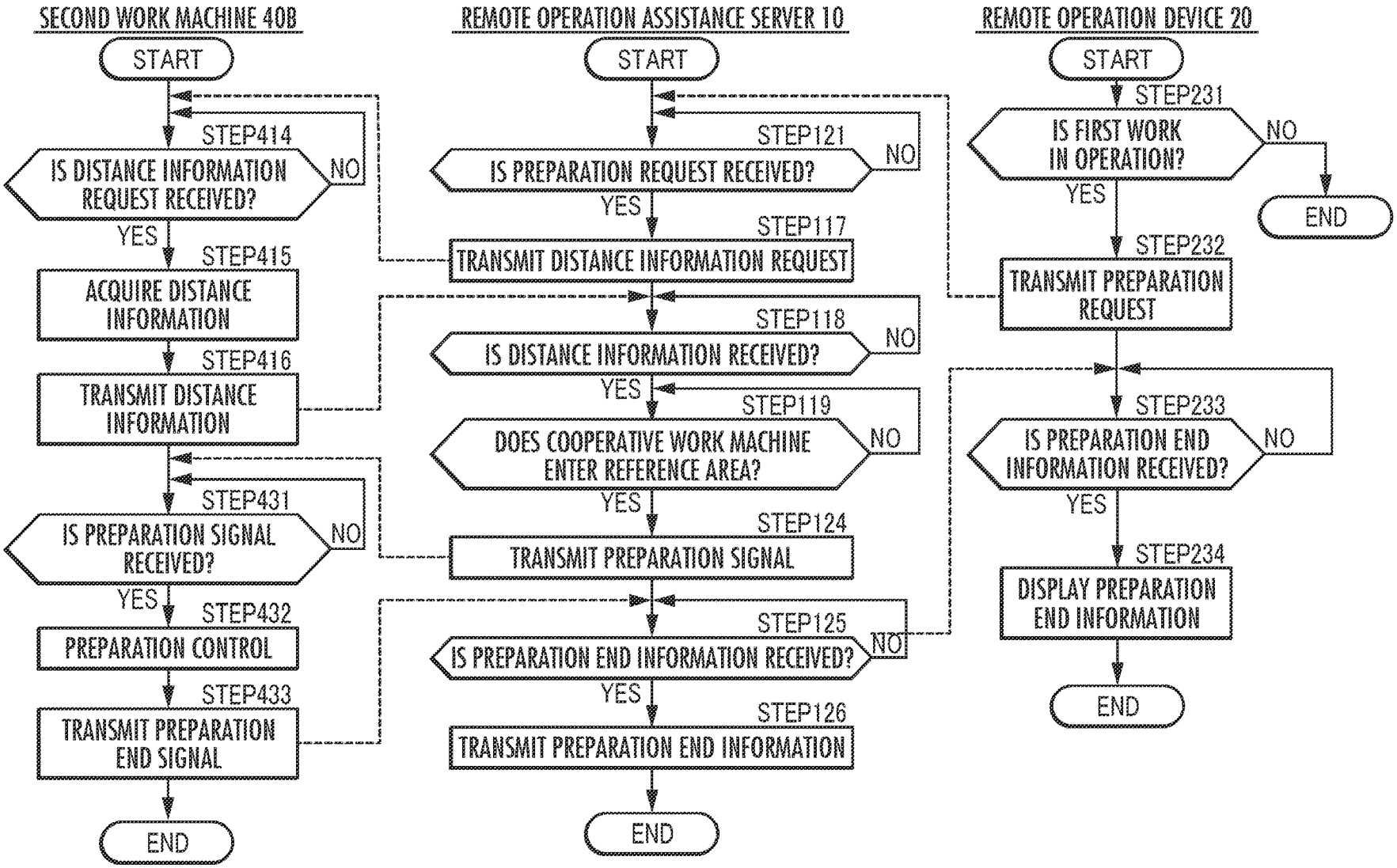
FIG. 7 is an explanatory view of preparation control as another embodiment of the present invention.

The remote operation device 20 determines whether or not the first work is in operation (STEP 231 in FIG. 7). Examples of the first work in operation may include a case where the current time is prescribed time (13:00 to 18:00) and the remote operation device 20 has an established communication that allows remote operation of the first work machine 40A. When the determination result is negative (NO in STEP 231 in FIG. 7), the remote operation device 20 ends the process. On the other hand, when the determination result is affirmative (YES in STEP 231 in FIG. 7), the remote operation device 20 transmits a preparation request to the remote operation assistance server 10 through the remote wireless communication device 222 (STEP 232 in FIG. 7).

When the remote operation assistance server 10 receives the preparation request (YES in STEP 121 in FIG. 7), the first assistance processing element 101 requests the information about the distance between the second work machine 40B and the cooperative work machine 50 to the second work machine 40B (STEP 117 in FIG. 7). On the other hand, when the determination result is negative (NO in STEP 121 in FIG. 7), the first assistance processing element 101 repeats the determination process in STEP 121.

When the second work machine 40B receives the distance information request (YES in STEP 414 in FIG. 7), the actual machine control device 400 acquires the information about the distance between the second work machine 40B and the cooperative work machine 50 (hereinafter also referred to as distance information, etc., as appropriate). On the other hand, when the determination result is negative (NO in STEP 414 in FIG. 7), the actual machine control device 400 repeats the determination process.

Here, for the distance information, the cooperative positioning device 416 (for example, a camera or a sensor such as the actual machine imaging device 412) measures the distance between the second work machine 40B and the cooperative work machine 50, and thereby the actual machine control device 400 acquires the distance information (STEP 415 in FIG. 7).

Although an example in which the distance information is acquired by using the cooperative positioning device 416 (a camera or a sensor such as the actual machine imaging device 412) is shown, examples of acquisition of the distance information are not limited to the example described. For example, when a camera or a sensor is arranged in the work site where the second work machine 40B is present, the first assistance processing element 101 can use the camera and the sensor or one of these to identify the positions of the work machine 40 and the cooperative work machine 50, and compute the distance between the coordinates where the second work machine 40B is present and the coordinates where the cooperative work machine 50 is present to acquire the distance information.

Moreover, there may be an example, in which when the cooperative work machine 50 is mounted with a positioning device (for example, a GNSS receiver) that detects the position of the cooperative work machine 50, the first assistance processing element 101 acquires the distance information by computing the distance between the coordinates where the second work machine 40B is present and the coordinates where the cooperative work machine 50 is present, based on the position information on the second work machine 40B measured by the actual machine positioning device 414 and the position information on the cooperative work machine 50 measured by the positioning device included in the cooperative work machine 50.

For the position information on the second work machine 40B, the actual machine positioning device 414 (for example, the GNSS receiver) acquires information about the coordinate position of the second work machine 40B (for example, the world coordinate position in the GNSS). Then, the actual machine control device 400 transmits the information about the coordinate position to the remote operation assistance server 10 through actual machine wireless communication device 422. This allows the remote operation assistance server 10 to acquire the position information on the second work machine 40B.

Although an example in which the information about the coordinate position of the second work machine 40B is acquired using the position of the world coordinates in the GNSS has been shown, examples of the remote operation assistance server 10 acquiring the information about the coordinate position of the second work machine 40B are not limited to this example. As another example of the remote operation assistance server 10 acquiring the position information on the second work machine 40B, the database 110 may store and retain local coordinates regarding the work site of the second work machine 40B in advance, and the actual machine positioning device 414 may measure which coordinates the second work machine 40B is located in a local coordinate system.

Meanwhile, for the position information on the cooperative work machine 50, the cooperative positioning device 416 acquires information about the coordinate position of the cooperative work machine 50 (for example, the position of the world coordinates in the GNSS). Then, the cooperative control device transmits the information about the coordinate position to the remote operation assistance server 10 through a cooperative wireless communication device. This allows the remote operation assistance server 10 to acquire the position information on the cooperative work machine 50.

Although an example in which the information about the coordinate position of the cooperative work machine 50 is acquired using the world coordinate position in the GNSS has been shown, examples of the remote operation assistance server 10 acquiring the information about the coordinate position of the cooperative work machine 50 are not limited to the example described. As another example of the remote operation assistance server 10 acquiring the position information on the cooperative work machine 50, the database 110 may store and retain local coordinates regarding the work site of the cooperative work machine 50 in advance, and the positioning device included in the cooperative work machine 50 may measure the position of the coordinates where the cooperative work machine 50 is located in the local coordinates.

As mentioned above, the first assistance processing element 101 may acquire the distance information by comparing the coordinates where the second work machine 40B is present with the coordinates where the cooperative work machine 50 is present and computing the distance between both the coordinates.

When the work machine 40 acquires the distance information, the actual machine control device 400 transmits the distance information to the remote operation assistance server 10 through the actual machine wireless communication device 422 (STEP 416 in FIG. 7).

In the remote operation assistance server 10, when the first assistance processing element 101 acquires distance information (YES in STEP 118 in FIG. 7), the first assistance processing element 101 determines whether or not the cooperative work machine 50 enters the reference area (STEP 119 in FIG. 7). On the other hand, when the determination result in STEP 118 is negative (NO in STEP 118 in FIG. 7), the first assistance processing element 101 repeats the process prior to the determination process.

In STEP 119, the first assistance processing element 101 reads the schedule information from the database 110, and determines whether or not the cooperative work machine 50, which is a work machine that performs work in cooperation with the second work machine 40B, moves into a reference area AR from the outside during a period from the start time to the end time of the first work performed by the first work machine 40A, the reference area AR being determined based on the position where the second work machine 40B is present.

For example, as shown in FIG. 8A, when the cooperative work machine 50 is located out of the reference area AR in the case where the second work machine 40B performs an excavation work (NO in STEP 119 in FIG. 7), the first assistance processing element 101 repeats the determination process.

Figure 8B:
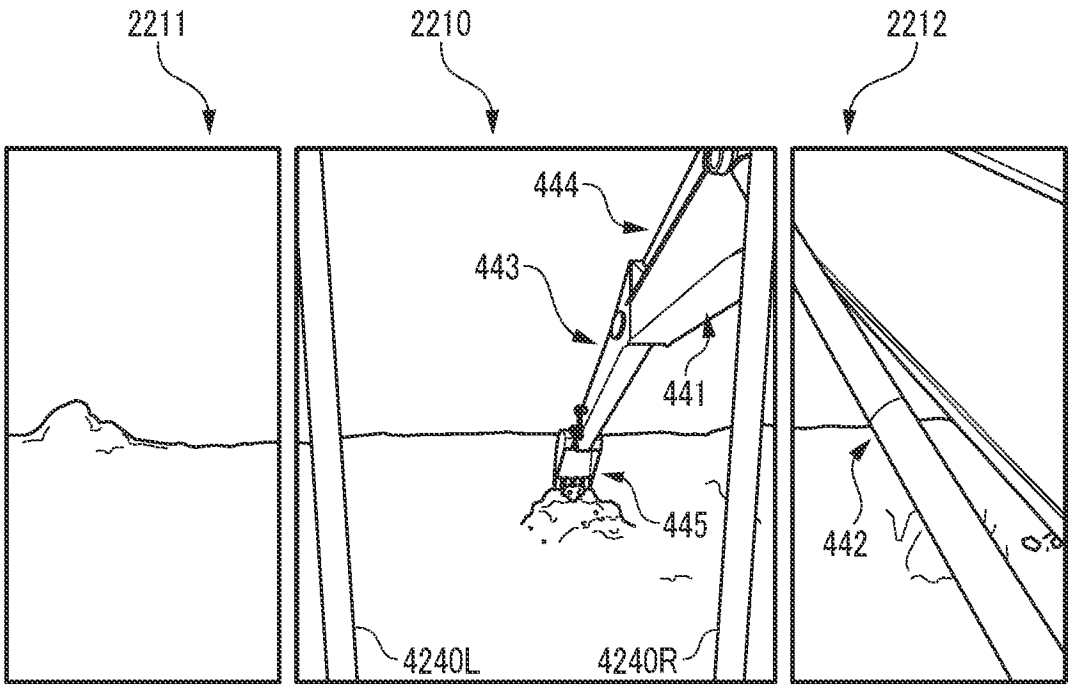
FIG. 8B is an explanatory view of the preparation control as another embodiment of the present invention.

In this case, as shown in FIG. 8B, the first assistance processing element 101 may transmit to the remote operation device 20 a command to divide and display an environment image of the work site, taken by the actual machine imaging device 412 included in the second work machine 40B, on the central image output device 2210, the left-side image output device 2211, and the right-side image output device 2212. In this case, since the second work machine 40B does not perform preparation control (turning), part of the work target area 80 in the second work machine 40B (for example, a sand mound 80C) is not photographed.

Figure 9A:
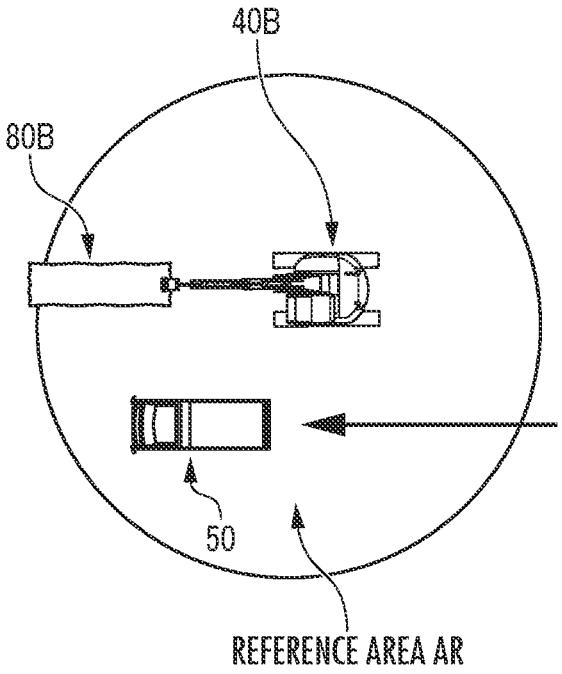
FIG. 9A is an explanatory view of the preparation control as another embodiment of the present invention.

On the other hand, as shown in FIG. 9A, when the cooperative work machine 50 moves into the reference area AR from the outside in the case where the second work machine 40B performs a loading work (YES in STEP 119 in FIG. 7), the first assistance processing element 101 transmits to the second work machine 40B a preparation signal (for example, a command signal to drive the lower traveling body 450 so as to retreat the second work machine 40B or to turn the upper turning body 460 so as to direct the actuating mechanism 440 in the direction where excavation of the channel 80B is scheduled for excavation of the work target area 80 (for example, the channel 80B)) (STEP 124 in FIG. 7).

Figure 9B:
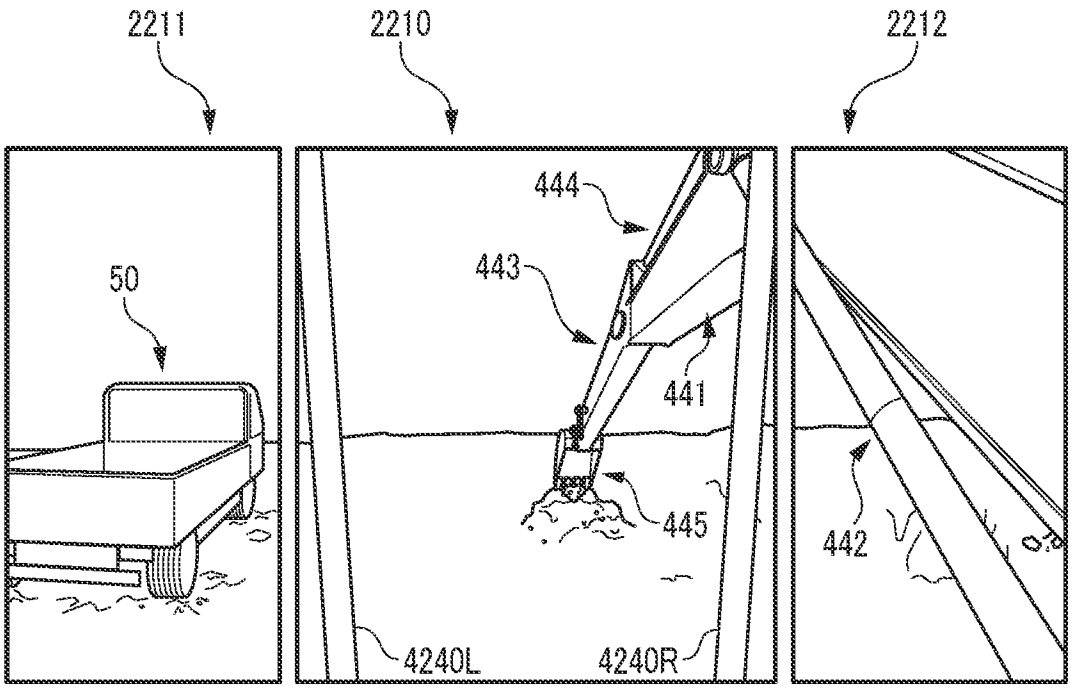
FIG. 9B is an explanatory view of the preparation control as another embodiment of the present invention.

In the second work machine 40B, when the actual machine control device 400 receives the preparation signal, (YES in STEP 431 in FIG. 7), preparation control (STEP 432 in FIG. 7) is started in the second work machine 40B as shown in FIG. 9B, so that the second work machine 40B drives the lower traveling body 450 to retreat the second work machine 40B or turns the upper turning body 460 so as to direct the actuating mechanism 440 in the direction where excavation of the channel 80B is scheduled.

In this case, as shown in FIG. 9B, the first assistance processing element 101 may transmit to the remote operation device 20 a command to divide and display an environment image of the work site, taken by the actual machine imaging device 412 included in the second work machine 40B, on the central image output device 2210, the left-side image output device 2211, and the right-side image output device 2212. In this case, since the second work machine 40B performs preparation control (turning), the channel 80B is photographed and the channel 80B is displayed on the central image output device 2210. The cooperative work machine 50 is also displayed on the left-side image output device 2211.

When the preparation for the work is finished, the work machine 40 transmits a preparation end signal, which is a signal including a signal of notifying the operator of the completion of the preparation for the work, to the remote operation assistance server 10 through the actual machine wireless communication device 422 (STEP 433 in FIG. 7).

In the remote operation assistance server 10, when the first assistance processing element 101 receives the preparation end signal (YES in STEP 125 in FIG. 7), the first assistance processing element 101 transmits the preparation end signal to the remote operation device 20. Meanwhile, when the determination result is negative (NO in STEP 125 in FIG. 7), the first assistance processing element 101 repeats the determination process in STEP 125.

In the remote operation device 20, when the remote control device 200 receives the preparation end signal (YES in STEP 233 in FIG. 7), the remote control device 200 performs preparation end display control that is control for notifying the operator of the information about the completion of the preparation for the work performed by the work machine 40 (STEP 234 in FIG. 7). On the other hand, when the determination result is negative (NO in STEP 233 in FIG. 7), the remote operation device 20 repeats the determination process in STEP 233.

The remote operation assistance device 100 and remote operation assistance system according to the present invention are also applicable to such cases. When the notification control (STEP 214 in FIG. 5) is performed in the remote operation device 20, the operator can interrupt the first work using the first work machine 40A and gets to the second work using the second work machine 40B. As shown in FIG. 9B, the cooperative work machine 50 is displayed on the left-side image output device 2211 when the notification control (STEP 214 in FIG. 5) is performed, which ensures that the operator can recognize the timing of getting to the second work using the second work machine 40B.

When the operator returns to the first work performed using the first work machine 40A after the completion of the second work using the second work machine 40B (an operation to excavate the channel 80B using the actuating mechanism 440 and to load the excavated soil and sand into the cooperative work machine 50), the remote operation device 20 determines whether or not the first work is in operation again (STEP 231 in FIG. 7). Thus, the remote operation assistance device 100 can perform, as the operation schedule of the work machines 40, the first work (a slope formation work) performed by the first work machine 40A after 13:00 and the second work (for example, a loading work sometimes performed by the operator interrupting the first work) performed by using the second work machine 40B.

Moreover, the first assistance processing element 101 does not transmit a preparation signal to the second work machine 40B during a period until the cooperative work machine 50 moves into the reference area AR from the outside. Accordingly, when the operator interrupts the first work performed by using the first work machine 40A in an optional timing and performs a work other than the second work using the second work machine 40B, the second work machine 40B is kept in the position or the attitude when the second work is interrupted, so that the operator can operate the second work machine 40B without any discomfort. After the cooperative work machine 50 moves into the reference area AR from the outside, the first assistance processing element 101 transmits the preparation signal to the second work machine 40B to set the second work machine 40B in a preparation attitude. This allows the operator to smoothly get to the second work performed by using the second work machine 40B.

In the above embodiment, as the example of the first assistance processing element performing the preparation control, there is shown an example in which the first assistance processing element determines whether or not the cooperative work machine 50 moves into the reference area AR from the outside, and when the determination is affirmative, the first assistance processing element transmits a preparation signal to the second work machine 40B. However, examples of the first assistance processing element performing the preparation control are not limited to this example. As another example of the first assistance processing element performing the preparation control, the reference area AR may include a first reference area AR1 and a second reference area AR2 that is set outside the reference area AR1, the first assistance processing element may determine whether or not the cooperative work machine 50 moves into the first reference area AR1 from the second reference area AR2, and when the decision is affirmative, the first assistance processing element may perform control to transmit a target preparation signal that is a signal different from the preparation signal.

Figure 10:
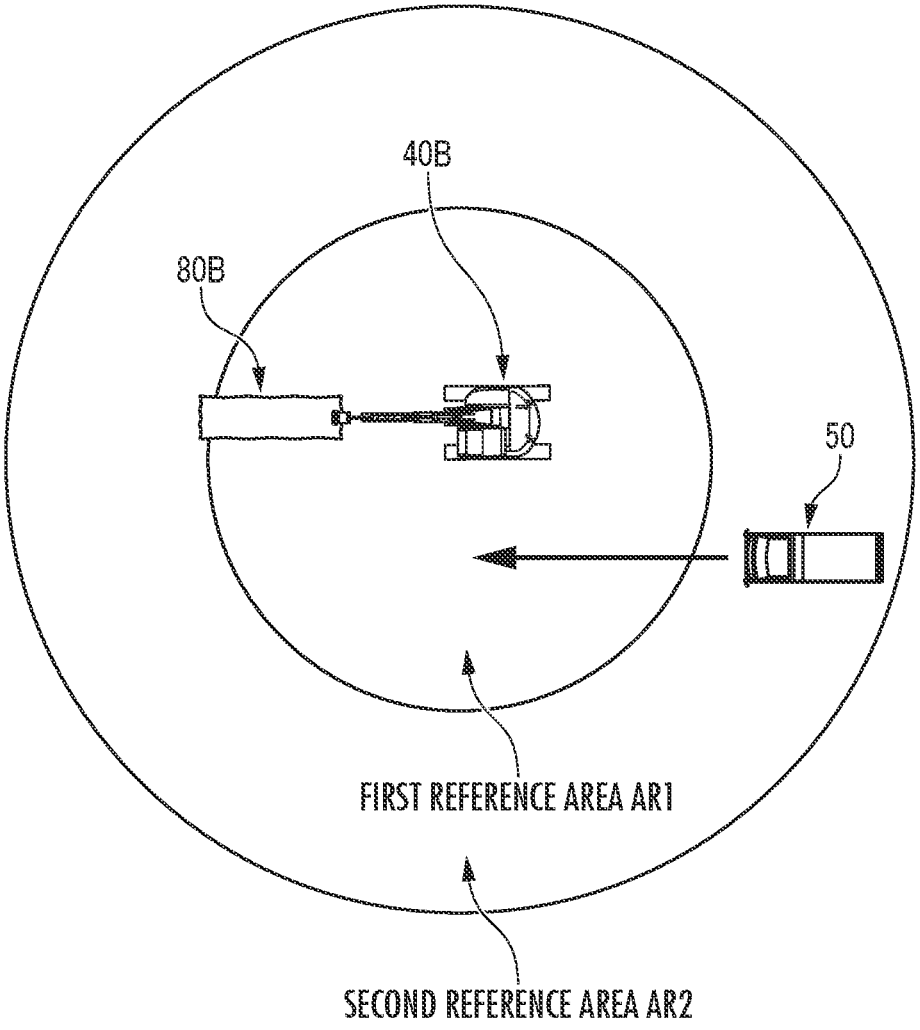
FIG. 10 is an explanatory view of the preparation control as another embodiment of the present invention.

For example, as shown in FIG. 10, when the cooperative work machine 50 is located within the second reference area AR2 in the case where the second work machine 40B performs the work of excavating the channel 80B and loading the excavated soil and sand, the second work machine 40B drives the lower traveling body 450 to retreat the second work machine 40B or turns the upper turning body 460 so as to direct the actuating mechanism 440 in the direction where the work target area 80 (for example, the channel 80B, the sand mound 80C) is located.

Figure 11:
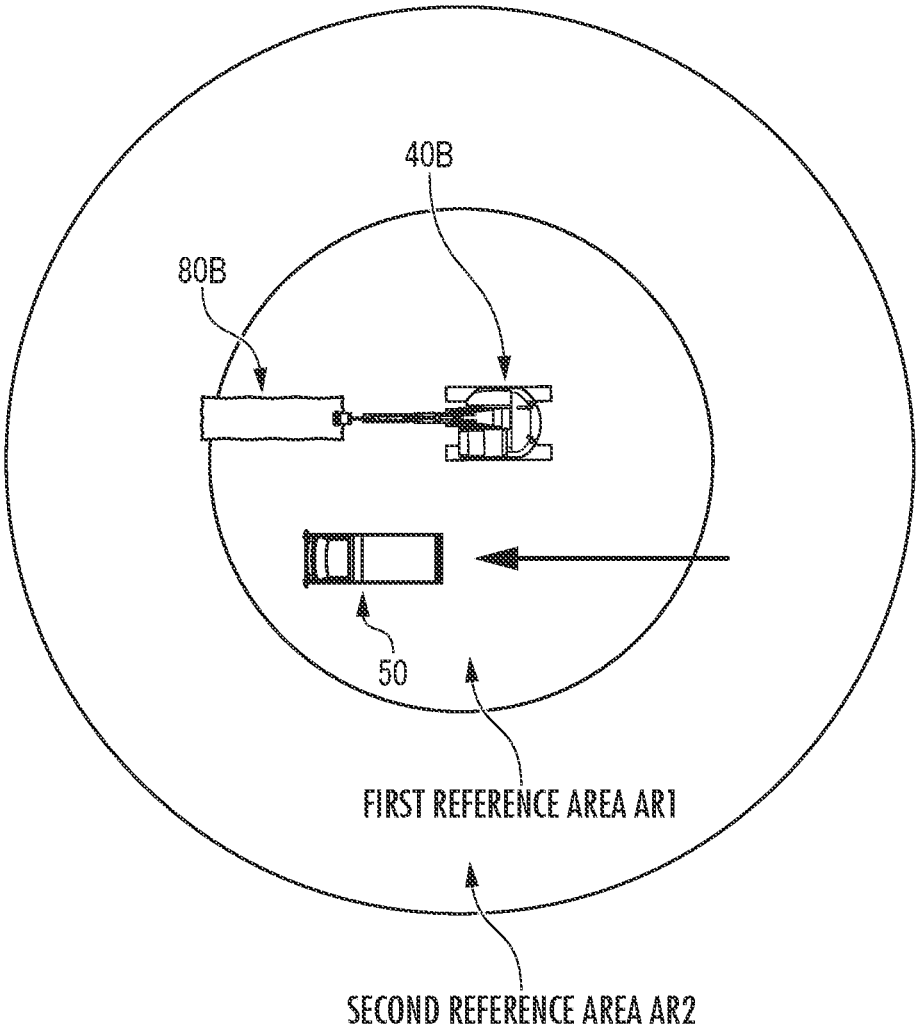
FIG. 11 is an explanatory view of preparation control as another embodiment of the present invention.

Then, as shown in FIG. 11, when the cooperative work machine 50 moves into the first reference area AR1 from the second reference area AR2, the first assistance processing element transmits a target preparation signal to the second work machine 40B.

For example, the target preparation signal is a control signal to extend the boom 441, the arm 443, and the bucket 445 so as to ground the bucket 445 at the position where the channel 80B is scheduled to be excavated.

As a result, as shown in FIG. 11, the second work machine 40B waits with the actuating mechanism 440 facing a scheduled position of excavating the channel 80B, which allows the operator to immediately get to the loading work. This allows the operator to immediately get to the work as compared with the case of performing the work by operating an unprepared second work machine 40B, so that work efficiency can be enhanced.

The remote operation assistance device 100 and the remote operation assistance system according to the present invention are also applicable to such cases.

In the above embodiment, an example is shown in which the reference area AR is determined as a circle based on the position where the second work machine 40B is present. However, the method of determining the reference area is not limited to the example described.

Figure 12:
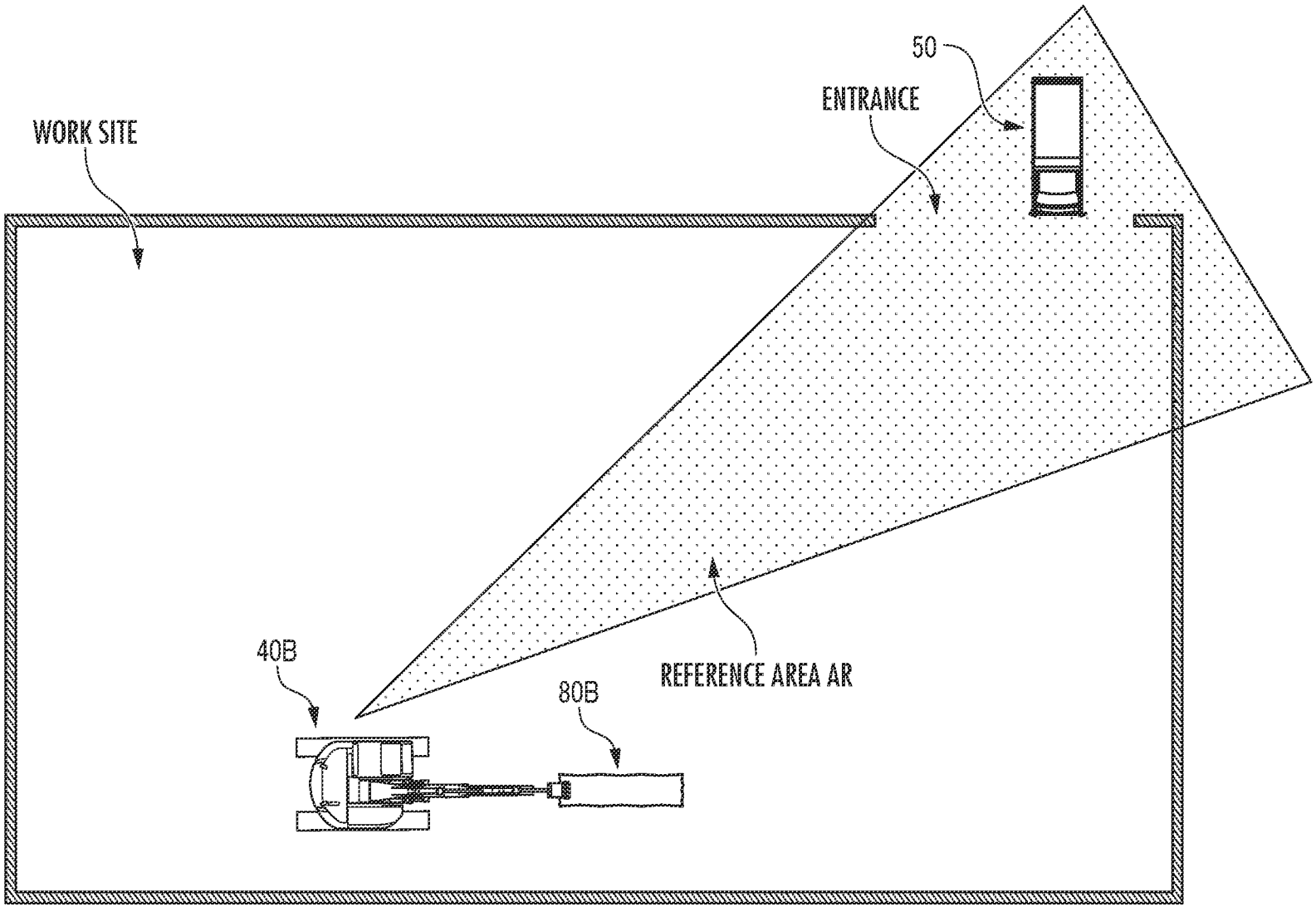
FIG. 12 is an explanatory view of preparation control as another embodiment of the present invention.

For example, as shown in FIG. 12, as another example of the method of determining the reference area AR, the reference area AR may be set to have a shape eccentrically expanding from the position where the second work machine 40B is present toward an entrance of a work site where the cooperative work machine 50 comes in and out to work in cooperation with the second work machine 40B.

According to such configuration, the reference area AR has a shape eccentrically expanding toward the entrance of the work site, and therefore the entrance that is a most likely entry point of the cooperative work machine 50 in the work site is reliably included in the reference area, and other parts of the reference area AR are set to be narrower. This make it possible to set a reasonable reference area AR. Hence, it is possible to reduce the probability of erroneously recognizing the work machine 40 not related to the preparation control as the cooperative work machine 50, and to thereby reduce the probability that the preparation control of the second work machine 40B is started due to erroneous recognition, so that the work efficiency can be enhanced.

In the above embodiment, an example has been shown in which the first assistance processing element 101 transmits a preparation signal to the work machine 40 when the cooperative work machine 50 moves into the reference area AR from the outside. However, examples of the first assistance processing element 101 transmitting the preparation signal to the work machine 40 are not limited to this example.

Figure 13:
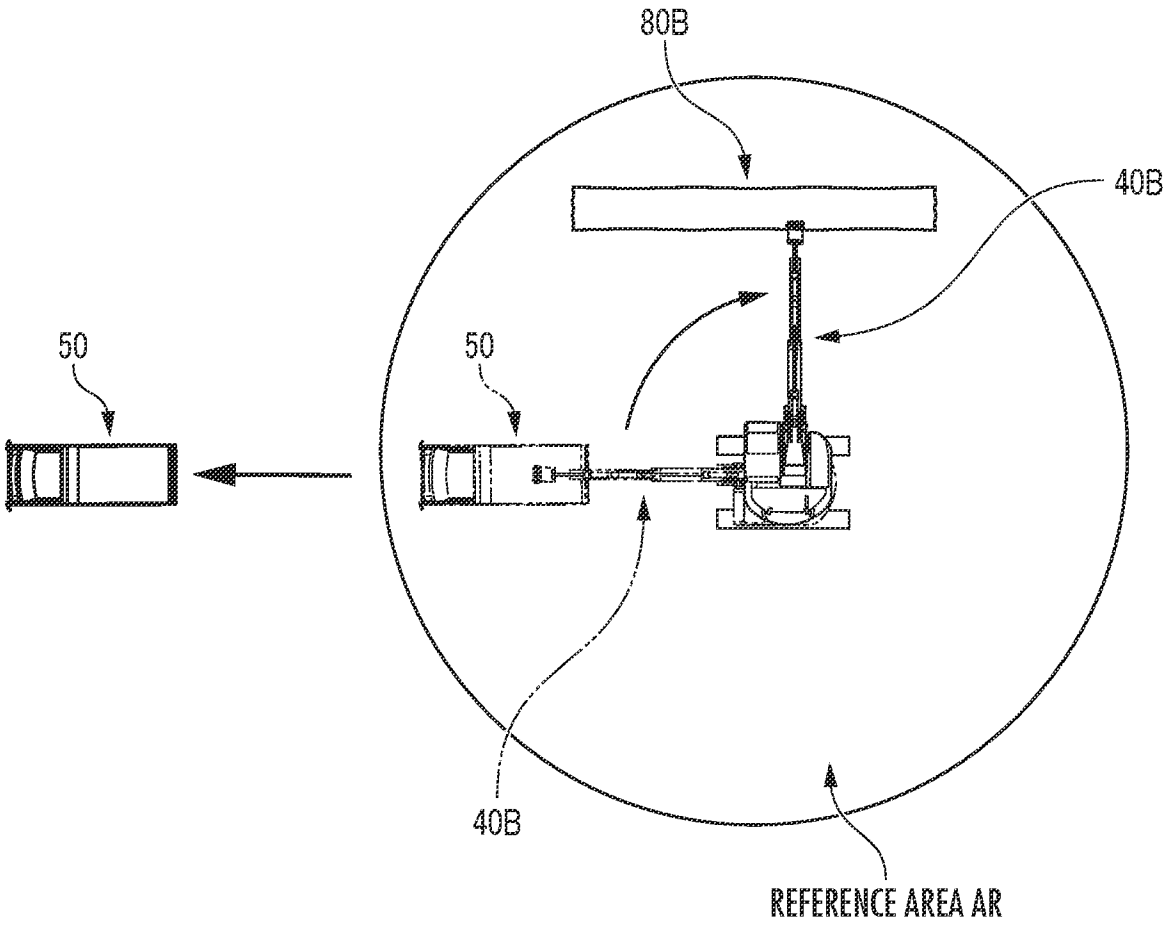
FIG. 13 is an explanatory view of preparation control as another embodiment of the present invention.

As another example of the first assistance processing element 101 transmitting the preparation signal to the work machine 40, the first assistance processing element 101 may transmit the preparation signal to the second work machine 40B when the cooperative work machine 50 moves to the outside of the reference area AR from the inside, as shown in FIG. 13.

According to such configuration, the first assistance processing element 101 transmits the preparation signal to the second work machine 40B when the cooperative work machine 50 moves from the inside of the reference area AR to the outside. Accordingly, after the cooperative work machine 50 advances to carry the soil and sand loaded on the loading platform, the second work machine 40B can wait with the upper turning body 460 being turned so as to direct the actuating mechanism 440 to the channel 80B for restart of the excavation work. This allows the operator to immediately get to the work as compared with the case of performing the work by operating an unprepared second work machine 40B, so that work efficiency can be enhanced.

The remote operation assistance device 100 and the remote operation assistance system according to the present invention are also applicable to such cases.

In the above embodiment, an example is shown in which the first assistance processing element 101 transmits the preparation signal to the second work machine 40B in accordance with the distance between the second work machine 40B and the cooperative work machine 50. However, examples of the first assistance processing element 101 transmitting the preparation signal are not limited to this example.

For example, there may be an example in which the first assistance processing element 101 transmits the preparation signal to the first work machine 40A in accordance with the distance between the first work machine 40A and the cooperative work machine 50.

The remote operation assistance device 100 and the remote operation assistance system according to the present invention are also applicable to such cases.

In the above embodiment, the work of excavating the channel 80B and loading the excavated soil and sand into the cooperative work machine 50 is shown as the second work performed using the second work machine 40B. However, examples of the second work are not limited to this example.

Examples of the second work may include an example of the work to unload carried objects that are mounted on the loading platform of the cooperative work machine 50. The carried objects, which are soil and sand for example, are picked up and unloaded using the bucket.

The carried objects may also be structures (for example, reinforcements). For example, the reinforcements may be grasped and unloaded by using a grapple that is an example of the actuating mechanism 440.

The remote operation assistance device 100 and the remote operation assistance system according to the present invention are also applicable to such cases.

In the above embodiment, an example is shown in which an example of the carried object mounted on the loading platform of the cooperative work machine 50 is a structure. However, examples of the carried object mounted on the loading platform of the cooperative work machine 50 are not limited to this example.

There may be an example in which the carried object mounted on the loading platform of the cooperative work machine 50 is timber. In this case, for example, the timber mounted on the loading platform of the cooperative work machine 50 is picked up and unloaded from the loading platform of the cooperative work machine 50 by being gripped and carried using the grapple as an example of the actuating mechanism 440.

The remote operation assistance device 100 and the remote operation assistance system according to the present invention are also applicable to such cases.

In the present invention, the first assistance processing element preferably determines that the preparation condition is satisfied when the current time is the time that is before the start time of the work performed by the work machine.

(Operational Effects)

According to such configuration, the first assistance processing element determines whether or not a preparation condition is satisfied based on the schedule information including time. Accordingly, by the time the operator starts to work, the work machine has already moved to the position suitable for the work or is in an attitude suitable for the work. This allows the operator to immediately get to the work as compared with the case of performing the work by operating an unprepared machine, so that work efficiency can be enhanced.

In the present invention, the first assistance processing element preferably determines that the preparation condition is satisfied, when a period of time from the start time to the end time of the first work stored in the database includes the start time of a second work stored in the database.

(Operational Effects)

According to such configuration, the database stores the schedule information including at least the content of the first work that is the work performed by remote operation of the first work machine, the start time of the first work, the content of the second work that is the work performed by remote operation of the second work machine, and the start time of the second work. The first assistance processing element determines based on the schedule information that the preparation condition is satisfied, when a scheduled time period of the second work stored in the database is included in a scheduled time period of the first work stored in the database. Accordingly, even in the case where an operator needs to perform the second work using the second work machine, while performing the first work using the first work machine, the second work machine starts to be controlled so as to move to the position suitable for the second work in advance or to take an attitude suitable for the second work in advance by the start time of the second work. This allows the operator to immediately get to the second work as compared with the case of performing the work by operating an unprepared second work machine, so that work efficiency can be enhanced.

In the present invention, the first assistance processing element transmits to the work machine a preparation signal that is a signal including a signal to drive a lower traveling body of the work machine.

(Operational Effects)

According to such configurations, when the preparation condition is satisfied, the first assistance processing element transmits to the work machine a preparation signal to drive the lower traveling body, so that the work machine can move in advance to the position suitable for the work by traveling. This allows the work machine as a target of remote control to move to the position suitable for the work in advance. Therefore, the operator can immediately get to the work as compared with the case of performing the work by operating an unprepared machine, so that work efficiency can be enhanced.

In the present invention, a preparation signal that is a signal including a signal to turn the upper turning body of the work machine is preferably transmitted to the work machine.

(Operational Effects)

According to such configurations, when the preparation condition is satisfied, the first assistance processing element transmits to the work machine a preparation signal to turn the upper turning body, so that the work machine can wait while facing in the direction suitable for the work in advance. This allows the work machine as a target of remote control to wait while facing in the direction suitable for the work in advance. Therefore, the operator can immediately get to the work as compared with the case of performing the work by operating an unprepared machine, so that work efficiency can be enhanced.

In the present invention, the first assistance processing element preferably transmits a preparation signal that is a signal including a signal to drive an actuating mechanism of the work machine to the work machine (Operational Effects)

According to such configuration, when the preparation condition is satisfied, the first assistance processing element transmits to the work machine a preparation signal to drive the actuating mechanism, so that the work machine can wait in an attitude suitable for the work by actuating the actuating mechanism in advance. This allows the work machine as a target of remote control to wait while taking an attitude suitable for the work in advance. For example, to make the work machine wait in a safer attitude, a preparation signal may be transmitted such that the work machine waits in an attitude with the bucket being grounded. For example, to get to the work more quickly, a preparation signal may be transmitted such that the work machine waits in an attitude with the bucket being lifted up. Hence, the operator can immediately get to the work as compared with the case of performing the work by operating the work machine not in the attitude suitable for work in advance, so that work efficiency can be enhanced.

In the present invention, the first assistance processing element preferably determines that the preparation condition is satisfied, when a cooperative work machine that is a machine to perform work in cooperation with a second work machine moves into a reference area that is determined based on a position where the second work machine is present from outside, the second work machine being set as an occasional target of remote operation by interrupting the remote operation of the first work machine by the operator.

(Operational Effects)

According to such configuration, the first assistance processing element determines that the preparation condition is satisfied when the cooperative work machine moves into the reference area from the outside. Accordingly, even when the cooperative work machine comes closer to the second work machine during a time period other than the time period when the work is scheduled to be performed, the second work machine starts to be controlled so as to move to the position suitable for a cooperative work in advance or to take an attitude suitable for the cooperative work in advance. This allows the operator to immediately get to the second work as compared with the case of performing the second work by operating an unprepared second work machine, so that work efficiency can be enhanced.

In the present invention, the first assistance processing element preferably determines that the preparation condition is satisfied, when a cooperative work machine that is a machine to perform work in cooperation with the second work machine moves into the reference area that is determined based on the position where the second work machine is present from the outside, during a period of time from start time to end time of the first work.

(Operational Effects)

According to such configuration, the first assistance processing element determines that the preparation condition is satisfied, when the cooperative work machine moves into the reference area that is determined based on the position where the second work machine is present from the outside during a period of time from the start time to the end time of the first work. Consequently, even in the case where the cooperative work machine moves closer to the second work machine while the operator is performing the first work, the operator continuously performs the first work, while the second work machine moves to the position suitable for the second work in advance or takes an attitude suitable for the second work in advance. Therefore, the operator can continue the first operation until immediately before the time point of getting to the second work. Therefore, the operator can continue the first work until immediately before the time point of getting to the second time, and then starts the second work by switching the operation to the prepared second work machine. This allows the operator to work more efficiently.

Therefore, even in the case where the second work machine is unable to move to the position suitable for the second work by the start time of the second work machine, the second work machine can still move to the position as suitable as possible for the second work. Also, even in the case where the second work machine is unable to take an attitude suitable for the second work by the start time of the second work machine, the second work machine can still take an attitude as suitable as possible for the second work. This allows the operator to get to the second work just a little earlier as compared with the case of performing the second work by operating a second work machine not prepared at all, so that work efficiency can be enhanced.

In the present invention, the reference area is preferably set to have a shape eccentrically expanding from the position where the second work machine is present toward an entrance of a work site where the cooperative work machine comes in and out to work in cooperation with the second work machine (Operational Effects)

According to such configuration, the reference area has a shape eccentrically expanding toward the entrance of the work site, so that the entrance that is a most likely entry point of the cooperative work machine in the work site is reliably included in the reference area, and other parts of the reference area are set to be narrower. This make it possible to set a reasonable reference area. Hence, it is possible to reduce the probability of erroneously recognizing the work machine that is not related to the preparation control as the cooperative work machine, and to thereby reduce the probability that the preparation control of the second work machine is started due to erroneous recognition. As a result, the work efficiency can be enhanced.

In the present invention, the remote operation assistance device preferably includes a second assistance processing element, and the second assistance processing element preferably executes the process of recognizing an operating mode of a remote operation mechanism that is operated for remote operation of the work machine and transmitting a remote operation command corresponding to the operation mode.

(Operational Effects)

According to such configuration, the work machine is remotely operated in accordance with the operating mode of the remote operation mechanism. This allows the operator to actually perform remote operation of the work machine prepared in a second assistance process by the second assistance processing element. This allows the operator to immediately get to the work as compared with performing the work by operating an unprepared machine, so that work efficiency can be enhanced.

REFERENCE SIGNS LIST

10 . . . remote operation assistance server, 20 . . . remote operation device, 40 . . . work machine, 40*a* . . . first work machine, 40*b* . . . second work machine, 50 . . . cooperative work machine, 100 . . . remote operation assistance device, 101 . . . first assistance processing element, 102 . . . second assistance processing element, 110 . . . database, 122 . . . server wireless communication device, 450 . . . lower traveling body, 460 . . . upper turning body, 440 . . . actuating mechanism, AR . . . reference area, 211 . . . remote operation mechanism.

The invention claimed is:

1. A remote operation assistance device used for execution of control to cause a first work machine, as a target of remote operation by an operator of a remote operation device, to start a preparation for work to be performed by the first work machine, the remote operation assistance device comprising:

a database storing scheduling information for the first work machine and a first work to be completed by the first work machine;

a computer-readable memory with computer-readable instructions for controlling the remote operation assistance device to communicate with the first work machine and the remote operation device to start a preparation for work by the first work machine; and a processor configured to execute the computer-readable instructions to execute a first assistance process configured to:

acquire, in response to a preparation request from the remote operation device, from the database schedule information that corresponds to the necessary information including a content of the first work that is the work performed by the first work machine, determine based on the schedule information whether or not a preparation condition is satisfied, the preparation condition being a condition for causing the first work machine to start the preparation for the first work, transmit to the first work machine, when the preparation condition is satisfied, a preparation signal that is a control signal for controlling the work machine to start the preparation for the first work, receive from the first work machine, a preparation end signal indicating that the preparation for the first work is finished, and transmit to the remote operation device the preparation end signal to notify the operator of the remote operation device of the completion of the preparation for the work so that the operator of the remote operation device can start operating the first work machine to perform the first work.

2. The remote operation assistance device according to claim 1, wherein the first assistance process is further configured to determine that the preparation condition is satisfied when current time is before start time of the first work.

3. The remote operation assistance device according to claim 1, wherein the first assistance process is further configured to determine that the preparation condition is satisfied, when a period of time from start time to end time of the first work stored in the database includes start time of a second work stored in the database.

4. The remote operation assistance device according to claim 1, wherein the first assistance process is further configured to transmit to the first work machine a preparation signal that is a signal including a signal to drive a lower traveling body of the first work machine.

5. The remote operation assistance device according to claim 1, wherein the first assistance process is further configured to transmit to the first work machine a preparation signal that is a signal including a signal to turn an upper turning body of the first work machine.

6. The remote operation assistance device according to claim 1, wherein the first assistance process is further configured to transmit to the first work machine a preparation signal that is a signal including a signal to actuate an actuating mechanism of the first work machine.

7. The remote operation assistance device according to claim 1, wherein the first assistance process is further configured to determine that the preparation condition is satisfied, when a cooperative work machine that is a machine to perform work in cooperation with a second work machine moves into a reference area that is determined based on a position where the second work machine is present from outside, the second work machine being set as an occasional target of remote operation by the operator interrupting the remote operation of the first work machine.

8. The remote operation assistance device according to claim 7, wherein the first assistance process is further configured to determine that the preparation condition is satisfied, when the cooperative work machine, that is a machine to perform work in cooperation with the second work machine, moves into the reference area that is determined based on the position where the second work machine is present from outside, during a period of time from start time to end time of the first work.

9. The remote operation assistance device according to claim 8, wherein the reference area is set to have a shape eccentrically expanding from the position where the second work machine is present toward an entrance of a work site where the cooperative work machine comes in and out to work in cooperation with the second work machine.

10. The remote operation assistance device according to claim 1, wherein the processor is further configured to execute the computer-readable instructions to execute a second assistance process configured to recognize an operating mode of a remote operation mechanism that is operated for remote operation of the work machine and transmit a remote operation command corresponding to the operation mode.

11. A remote operation assistance method used for execution of control to cause a first work machine, as a target of remote operation by an operator of a remote operation device, to start a preparation for work to be performed by the first work machine, the method comprising a first assistance processing step of acquiring, in response to a preparation request from the remote operation device, schedule information that corresponds to the necessary information including a content of the first work that is the work performed by the first work machine from a database storing the schedule information, determining based on the schedule information whether or not a preparation condition is satisfied, the preparation condition being a condition for causing the first work machine to start preparation for the first work, transmitting to the first work machine, when the preparation condition is satisfied, a preparation signal that is a control signal for controlling the work machine to start the preparation for the first work, receiving from the first work machine, a preparation end signal indicating that the preparation for the first work is finished, and transmitting to the remote operation device the preparation end signal to notify the operator of the remote operation device of the completion of the preparation for the work so that the operator of the remote operation device can start operating the first work machine to perform the first work.

12. The remote operation assistance device according to claim 7, wherein the reference area is set to have a shape eccentrically expanding from the position where the second work machine is present toward an entrance of a work site where the cooperative work machine comes in and out to work in cooperation with the second work machine.

* * * * *